US010584942B2

(12) United States Patent
Wellman et al.

(10) Patent No.: US 10,584,942 B2
(45) Date of Patent: Mar. 10, 2020

(54) BALLISTIC-RESISTANT GARMENT HAVING AN INCREMENTALLY ADJUSTABLE FIT

(71) Applicant: Angel Armor, LLC, Fort Collins, CO (US)

(72) Inventors: Matthew J. Wellman, Fort Collins, CO (US); Alan V. Morine, Fort Collins, CO (US); Ross M. Hinschberger, Cheyenne, WY (US)

(73) Assignee: Angel Armor, LLC, Fort Collins, CO (US)

( * ) Notice: Subject to any disclaimer, the term of this patent is extended or adjusted under 35 U.S.C. 154(b) by 0 days.

(21) Appl. No.: 15/451,225

(22) Filed: Mar. 6, 2017

(65) Prior Publication Data

US 2017/0205205 A1 Jul. 20, 2017

Related U.S. Application Data

(63) Continuation of application No. 15/407,155, filed on Jan. 16, 2017, now Pat. No. 10,495,418.

(Continued)

(51) Int. Cl.
*F41H 5/013* (2006.01)
*F41H 1/02* (2006.01)

(Continued)

(52) U.S. Cl.
CPC ..... *F41H 5/013* (2013.01); *A41D 1/04* (2013.01); *A41D 13/0153* (2013.01); *A41D 13/0568* (2013.01); *F41H 1/02* (2013.01)

(58) Field of Classification Search
CPC ..... F41H 5/013; F41H 1/02; A41D 13/0153; A41D 1/04; A41D 13/0568

(Continued)

(56) References Cited

U.S. PATENT DOCUMENTS 3,452,362 A * 7/1969 Korolick ..... F41H 1/02 2/2.5
5,031,733 A * 7/1991 Chang ..... A41D 15/04 190/1

(Continued)

FOREIGN PATENT DOCUMENTS

DE 1924456 A1 * 1/1970
DE 3150858 A1 * 7/1983
WO 2011/141172 11/2011

OTHER PUBLICATIONS

U.S. Appl. No. 62/278,811, filed Jan. 14, 2016.

(Continued)

*Primary Examiner* — Alissa J Tompkins
*Assistant Examiner* — Brieanna Szafran
(74) *Attorney, Agent, or Firm* — Craig R. Miles; CR Miles P.C.

(57) ABSTRACT

A ballistic-resistant garment having an incrementally-adjustable fit, and methods of making and using such a ballistic-resistant garment, whereby the ballistic-resistant garment includes a front panel having a front panel pocket configured to receive a first ballistic-resistant insert; a back panel having a back panel pocket configured to receive a second ballistic-resistant insert; a front panel first fastener coupled to the front panel; and a plurality of discrete back panel first fasteners coupled in spaced apart relation to the back panel, whereby each of the discrete back panel first fasteners is configured to matably engage with the front panel first fastener to provide a first pair of releasably engaged fasteners which couple the front and back panels to fasten the ballistic-resistant garment about a torso of a wearer.

13 Claims, 21 Drawing Sheets

Related U.S. Application Data

(60) Provisional application No. 62/279,202, filed on Jan. 15, 2016, provisional application No. 62/278,811, filed on Jan. 14, 2016.

(51) Int. Cl.
*A41D 13/015* (2006.01)
*A41D 13/05* (2006.01)
*A41D 1/04* (2006.01)

(58) Field of Classification Search
USPC ..... 2/102, 2.5
See application file for complete search history.

(56) References Cited

U.S. PATENT DOCUMENTS 7,987,523 B2 * 8/2011 Cole ..... A45F 5/00 2/102
8,490,212 B1 * 7/2013 Asher ..... A41D 1/04 2/2.5
2010/0205708 A1 * 8/2010 Storms, Jr. ..... A41D 13/05 2/2.5
2011/0023207 A1 * 2/2011 Storms, Jr. ..... A41D 1/04 2/102
2011/0113520 A1 * 5/2011 Dennis ..... F41H 1/02 2/2.5
2014/0215679 A1 * 8/2014 Habip ..... A41D 13/0506 2/23
2017/0199011 A1 * 7/2017 Beck ..... F41H 5/0471

OTHER PUBLICATIONS

U.S. Appl. No. 62/279,202, filed Jan. 15, 2016.
U.S. Appl. No. 15/407,155, filed Jan. 16, 2017.
TenCate Advanced Armor. TenCate Multi-light™ CXP-461 IC Torso. Website, https://www.tencateadvancedarmor.com/personal-protection/Body-armor-plates/TenCate-Multi-light-hard-body-armor-plates/4Tpr/TenCate-Multi-light-CXP-461-IC-Torso, originally downloaded Feb. 25, 2019, one page.
Aegiscontrols. Ballistic Door Panel Level IIIa. Website, www.aegiscontrols.net; originally downloaded May 9, 2019, 2 pages.

* cited by examiner

BALLISTIC-RESISTANT GARMENT HAVING AN INCREMENTALLY ADJUSTABLE FIT

This United States Patent Application is a continuation of U.S. patent application Ser. No. 15/407,155, filed Jan. 16, 2017, which claims the benefit of United States Provisional Patent Application No. 62/279,202, filed Jan. 15, 2016, and United States Provisional Patent Application No. 62/278,811, filed Jan. 14, 2016, each hereby incorporated by reference herein.

I. SUMMARY OF THE INVENTION

A broad object of a particular embodiment of the invention can be to provide a ballistic-resistant garment having an incrementally-adjustable fit, and methods of making and using such a ballistic-resistant garment, whereby the ballistic-resistant garment includes a front panel having a front panel pocket configured to receive a first ballistic-resistant insert; a back panel having a back panel pocket configured to receive a second ballistic-resistant insert; a front panel first fastener coupled to the front panel; and a plurality of discrete back panel first fasteners coupled in spaced apart relation to the back panel, whereby each of the discrete back panel first fasteners is configured to matably engage with the front panel first fastener to provide a first pair of releasably engaged fasteners which couple the front and back panels to fasten the ballistic-resistant garment about a torso of a wearer.

II. BRIEF DESCRIPTION OF THE DRAWINGS

Figure 6A:
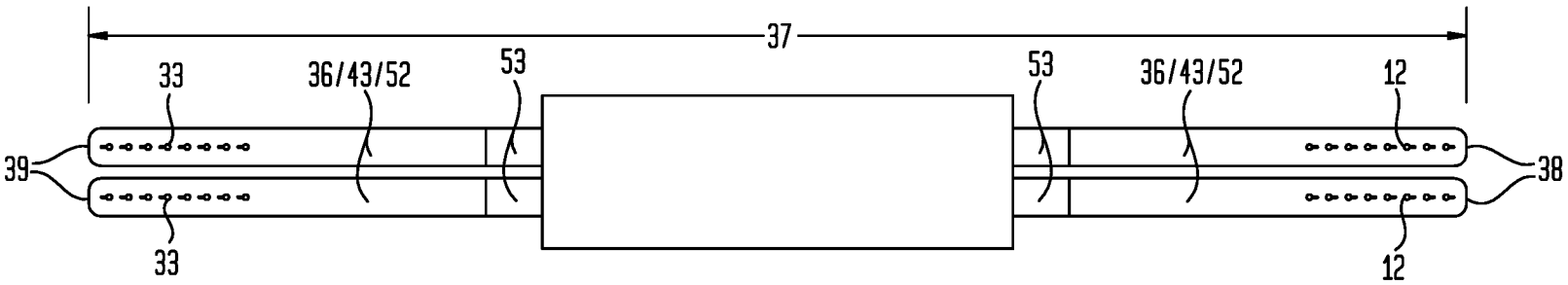
FIG. 6A is a front view of a particular embodiment of an unfurled elongate member of the inventive ballistic-resistant garment, whereby a plurality of discrete back panel fasteners are coupled in spaced apart relation to the elongate member proximate opposing elongate member ends.
Figure 6B:
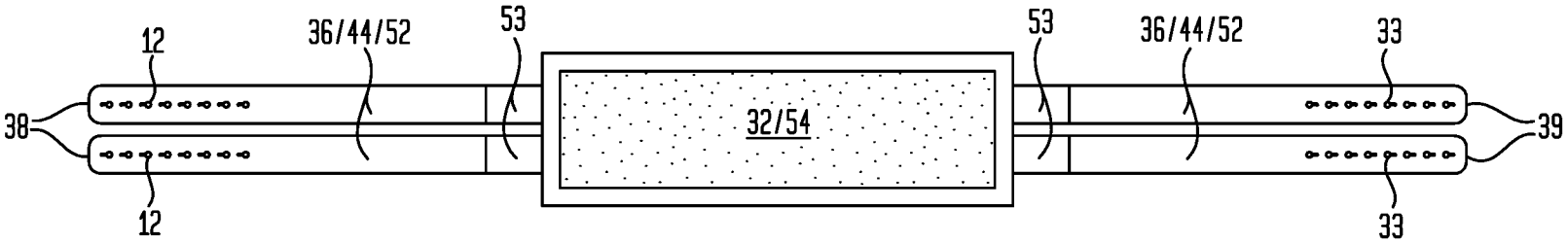
FIG. 6B is a rear view of the particular embodiment of the elongate member shown in FIG. 6A.
Figure 6C:
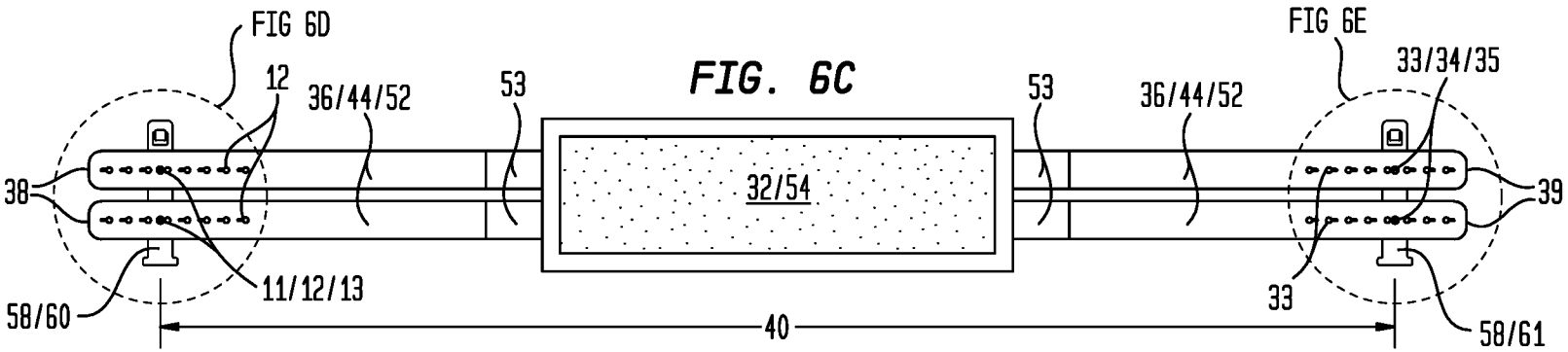

FIG. 6C is a front view of a particular embodiment of an unfurled elongate member of the inventive ballistic-resistant garment, whereby a plurality of discrete back panel fasteners are coupled in spaced apart relation to the elongate member proximate opposing elongate member ends, and whereby some of the plurality of discrete back panel fasteners are matably engaged with front panel fasteners fixedly coupled to elongate connectors.

Figure 6D:
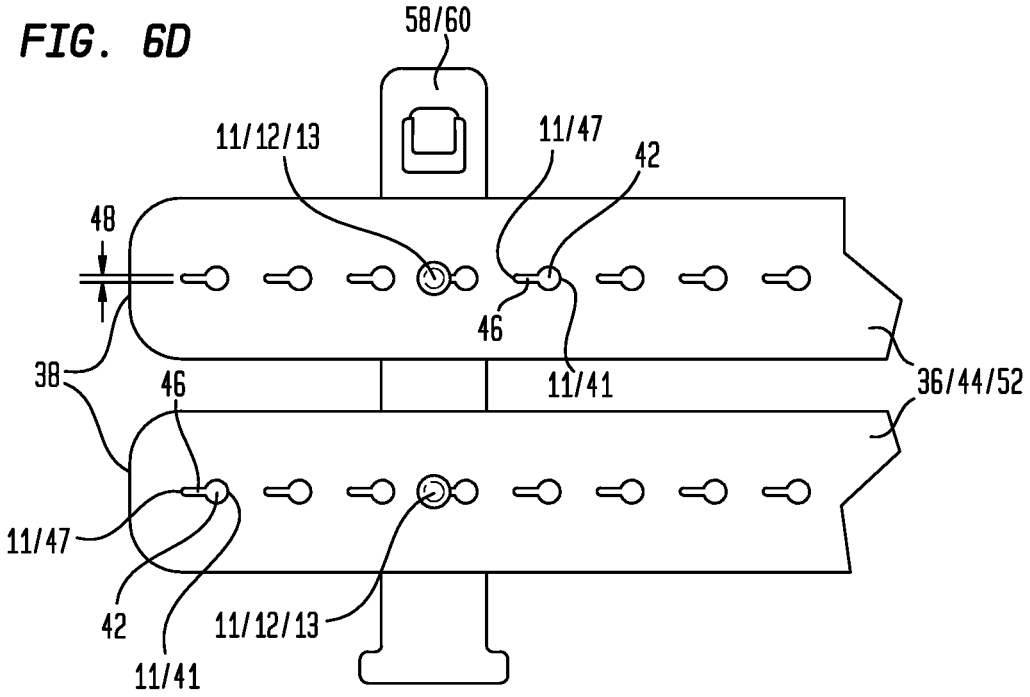

FIG. 6D is an enlarged view of the pair of back panel first fasteners matably engaged with the pair of front panel first fasteners shown in FIG. 6C.

Figure 6E:
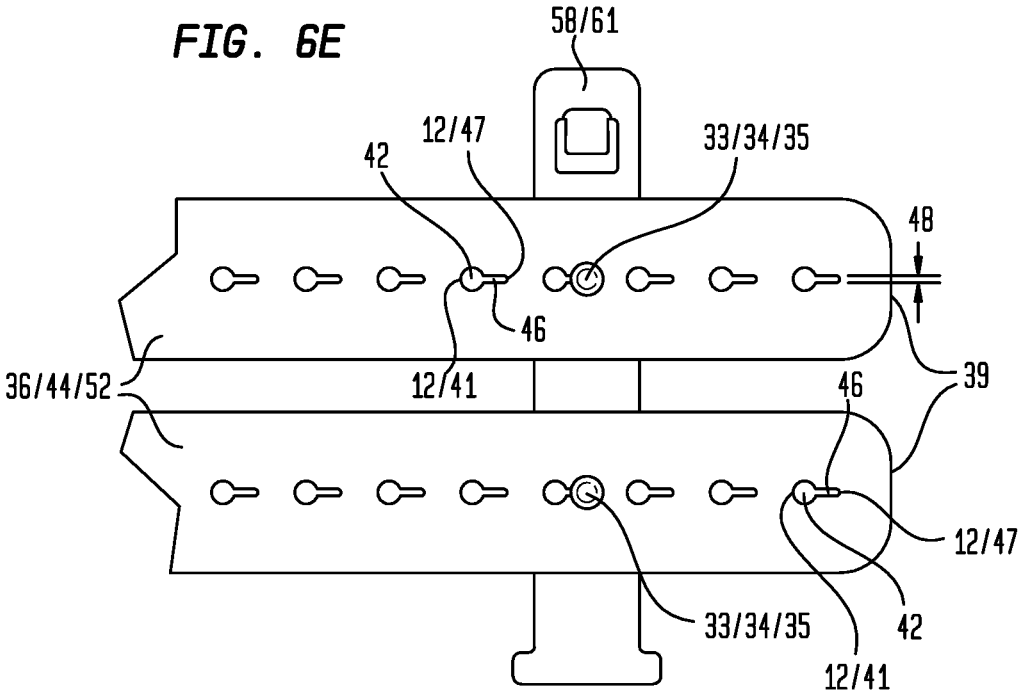

FIG. 6E is an enlarged view of the pair of back panel second fasteners matably engaged with the pair of front panel second fasteners shown in FIG. 6C.

Figure 7B:
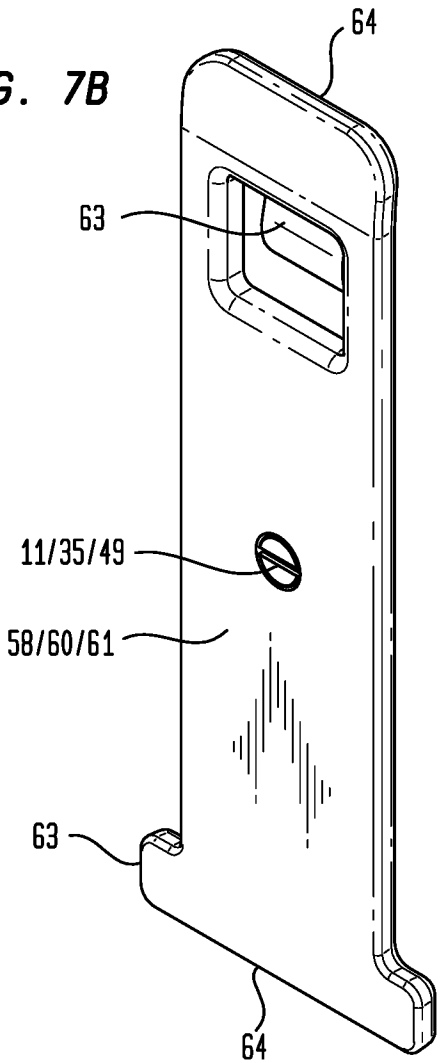
Figure 7A:
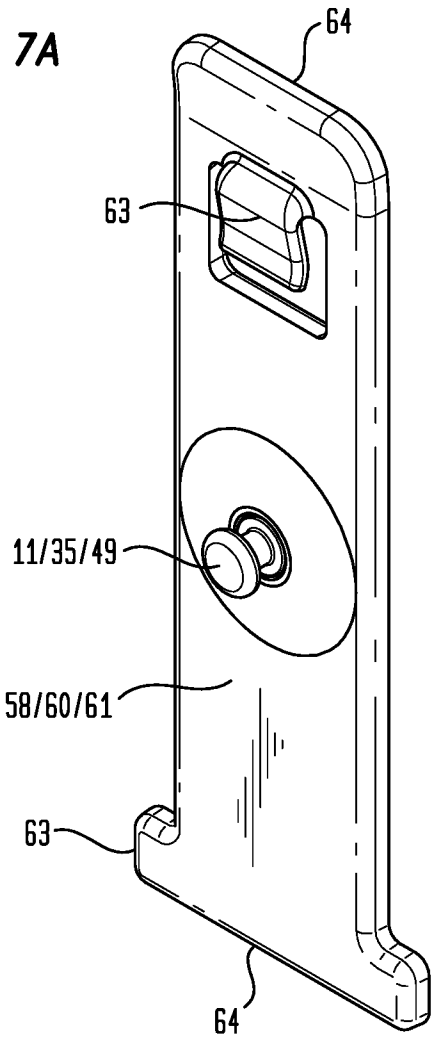

FIG. 7A is a perspective view of a front of a particular embodiment of an elongate connector of the inventive ballistic-resistant garment, whereby a front panel fastener is fixedly coupled to the elongate connector.

FIG. 7B is a perspective view of a back of the elongate connector shown in FIG. 7A.

Figure 7F:
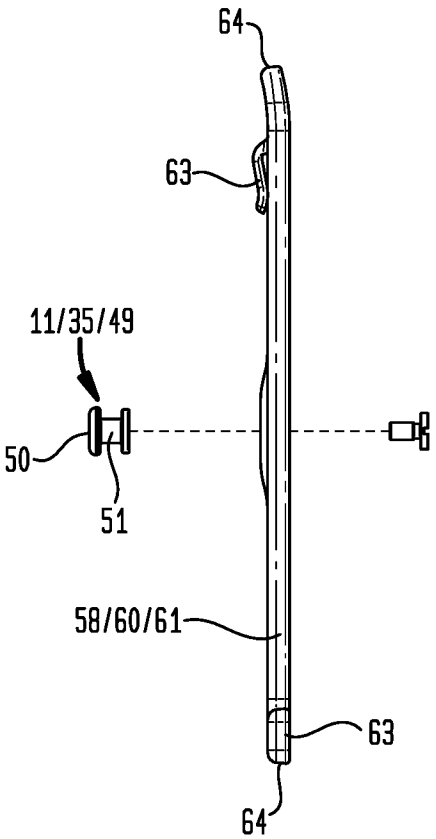
Figure 7C:
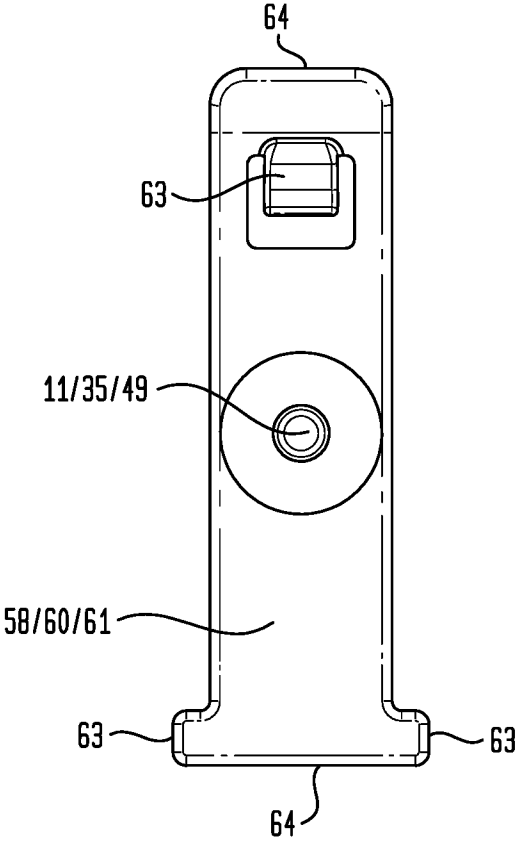

FIG. 7C is a front view of the elongate connector shown in FIG. 7A.

Figure 7E:
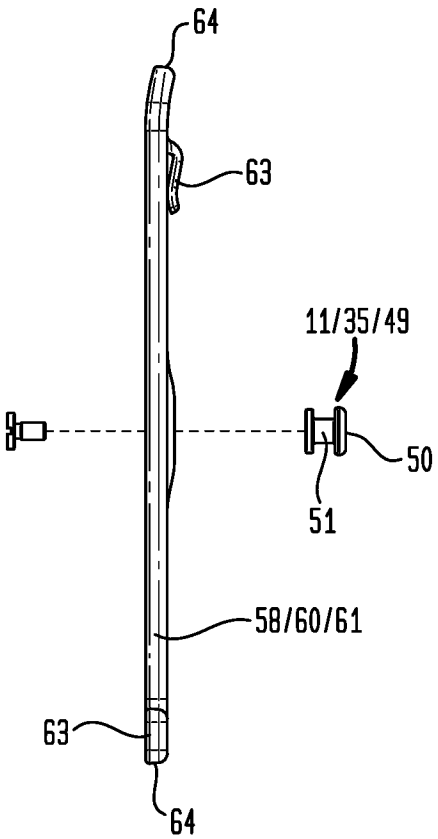
Figure 7G:
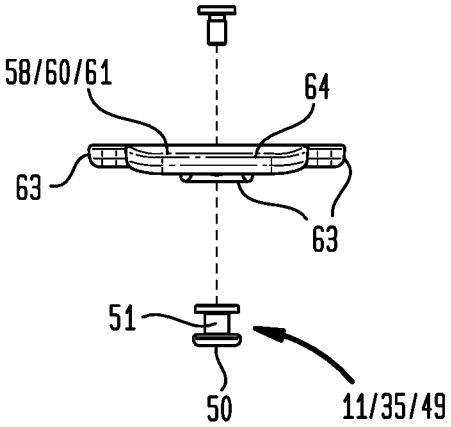
Figure 7H:
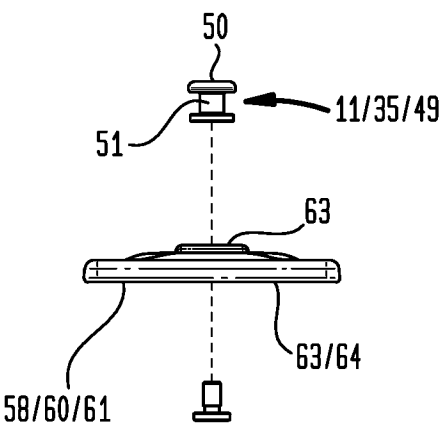
Figure 7D:
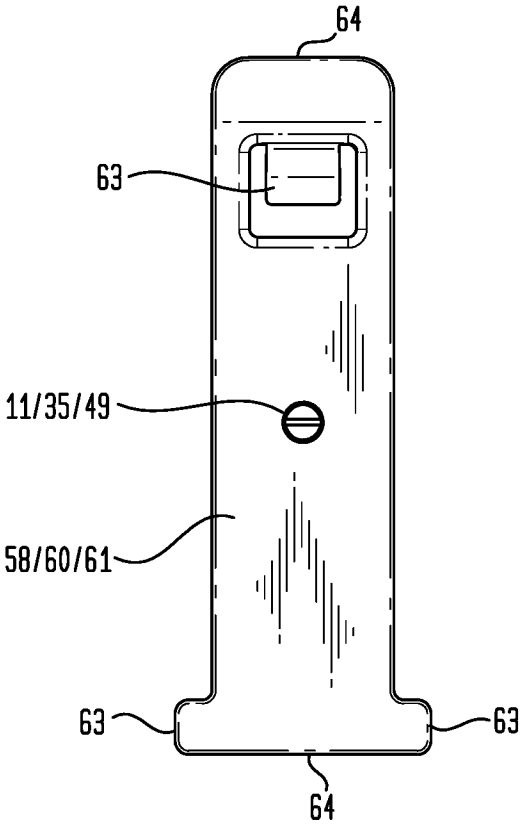

FIG. 7D is a rear view of the elongate connector shown in FIG. 7A.

FIG. 7E is a right side view of the elongate connector shown in FIG. 7A, but whereby the front panel fastener is outwardly exploded from the elongate connector.

FIG. 7F is a left side view of the elongate connector shown in FIG. 7A, but whereby the front panel fastener is outwardly exploded from the elongate connector.

FIG. 7G is a top view of the elongate connector shown in FIG. 7A, but whereby the front panel fastener is outwardly exploded from the elongate connector.

FIG. 7H is a bottom view of the elongate connector shown in FIG. 7A, but whereby the front panel fastener is outwardly exploded from the elongate connector.

Figure 8:
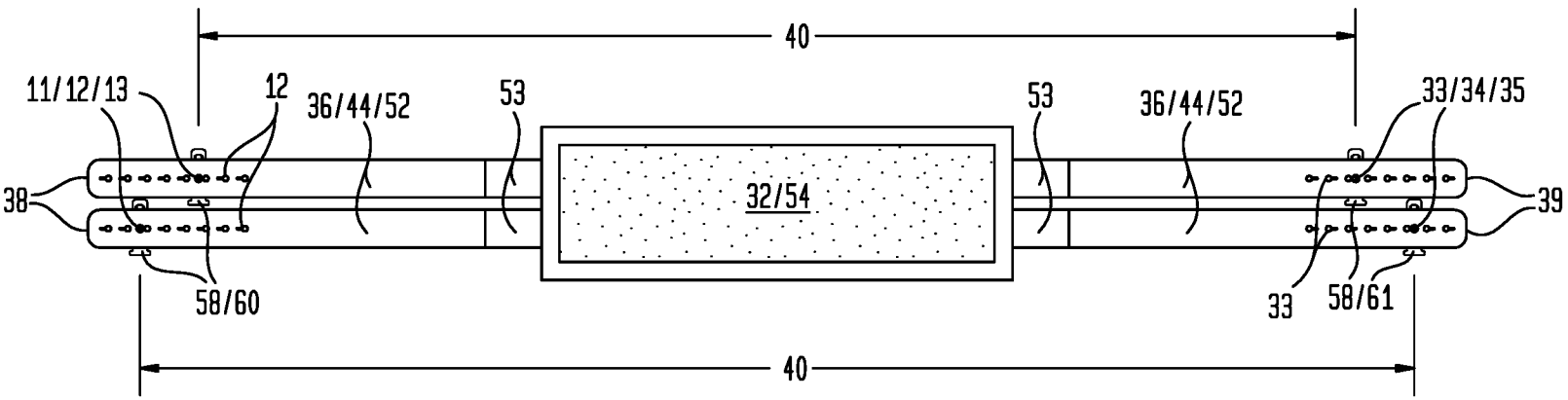

FIG. 8 is a front view of a particular embodiment of an unfurled elongate member of the inventive ballistic-resistant garment, whereby a plurality of discrete back panel fasteners are coupled in spaced apart relation to the elongate member proximate opposing elongate member ends, and whereby some of the plurality of discrete back panel fasteners are matably engaged with front panel fasteners fixedly coupled to elongate connectors.

III. DETAILED DESCRIPTION OF THE INVENTION

Figure 1:
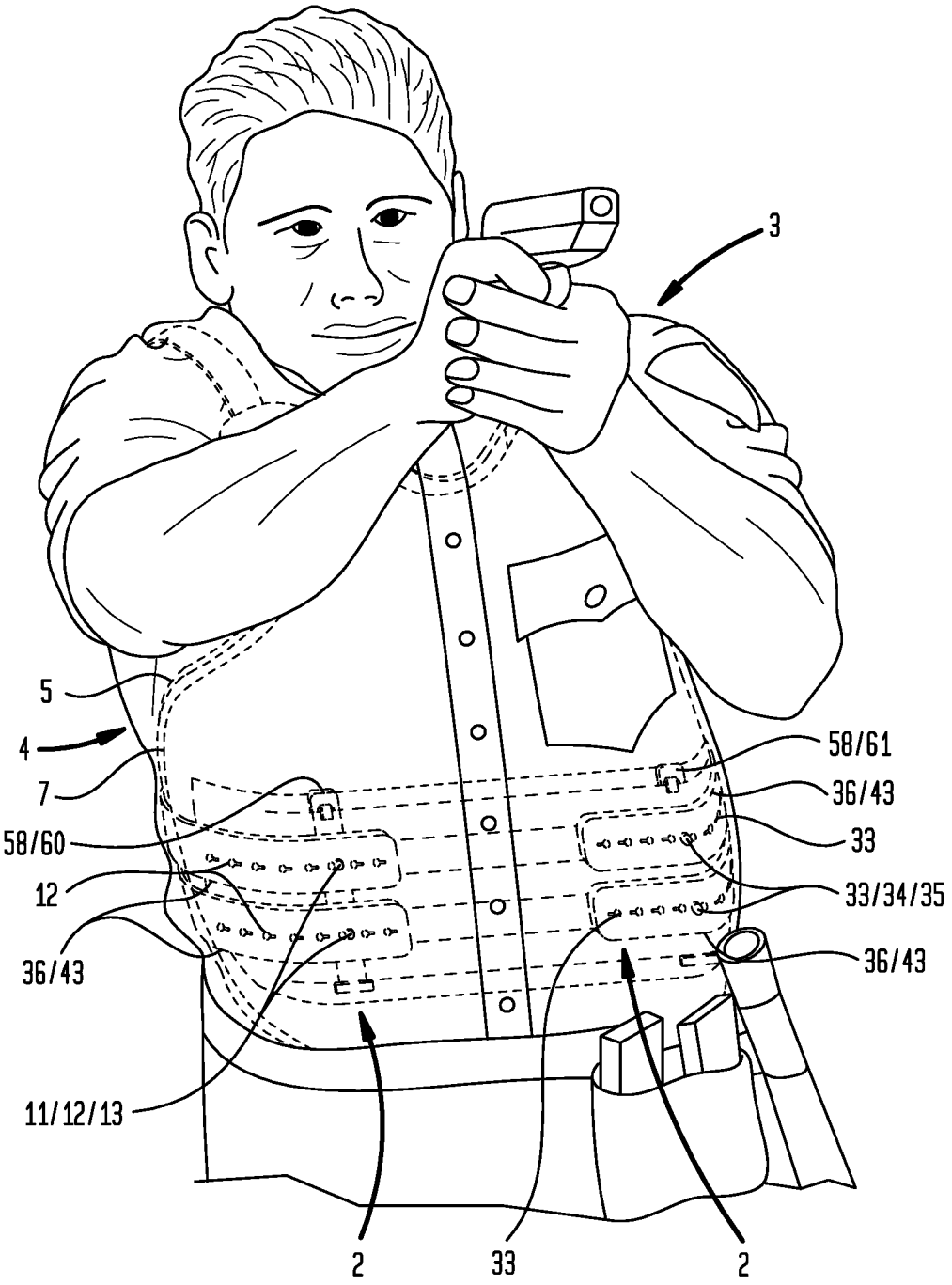
FIG. 1 is an illustration of a method of using a particular embodiment of the inventive ballistic-resistant garment to protect a torso of a wearer from ballistic threats.
Figure 2A:
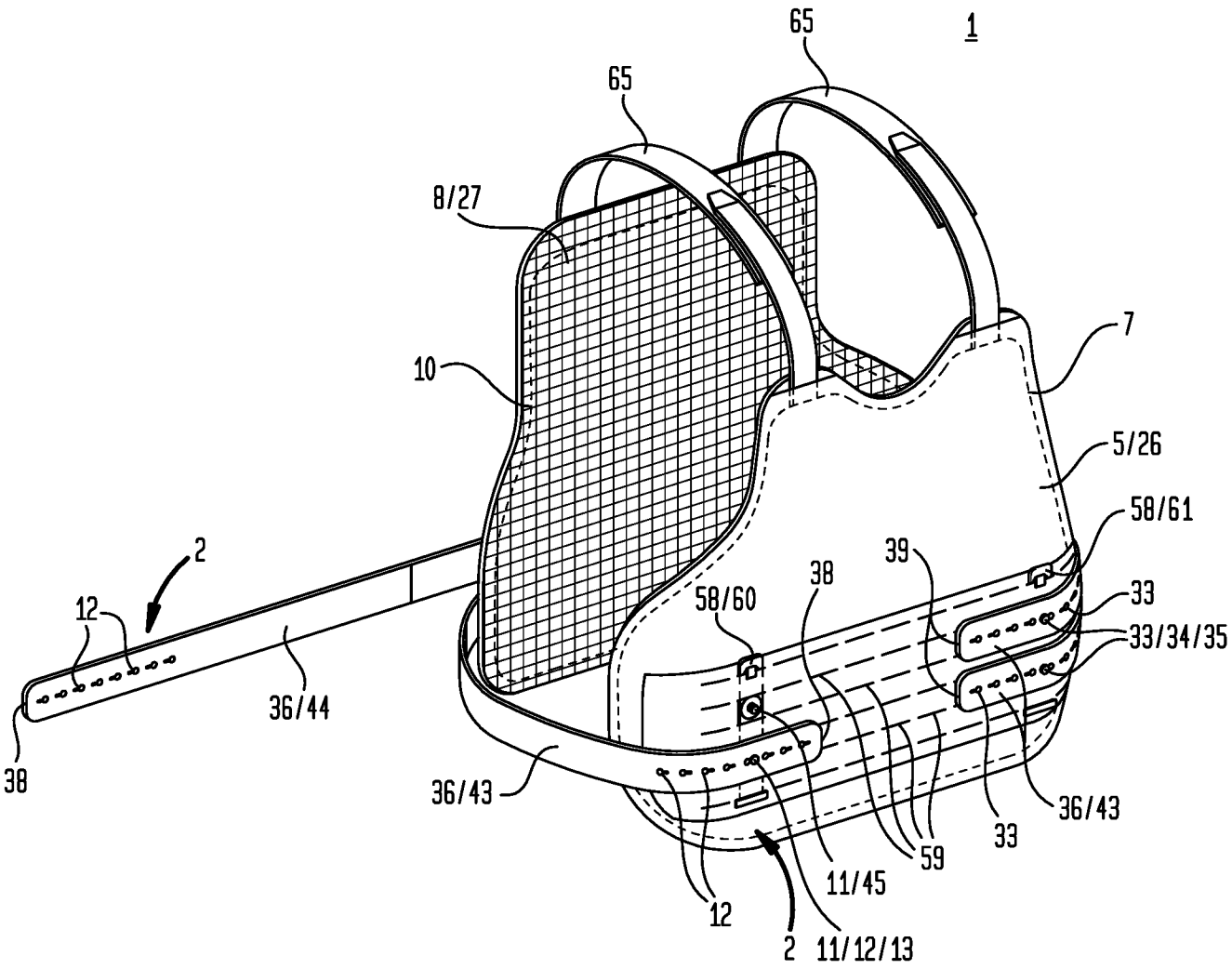
FIG. 2A is a perspective view of a particular embodiment of the inventive ballistic-resistant garment.
Figure 2B:
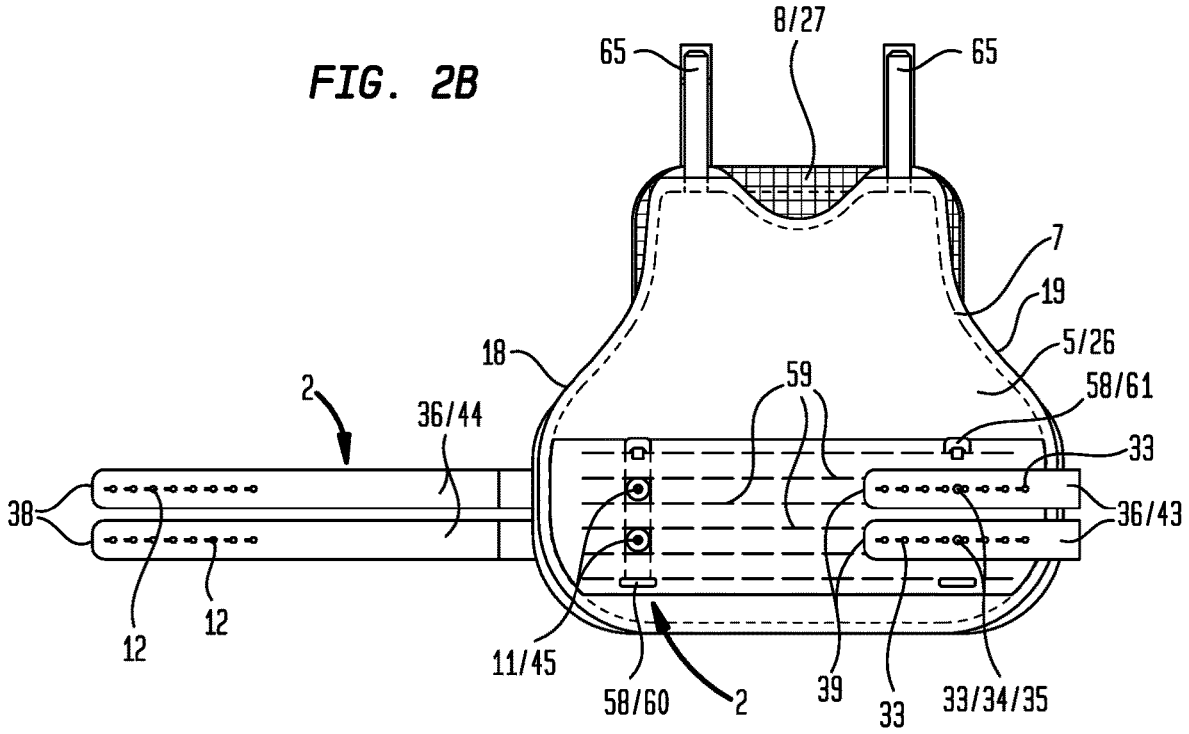
FIG. 2B is a front view of a particular embodiment of the inventive ballistic-resistant garment, whereby front and back panel left sides are coupled together by matable engagement of at least one discrete back panel fastener with at least one front panel fastener to provide at least one pair of releasably engaged fasteners.
Figure 2C:
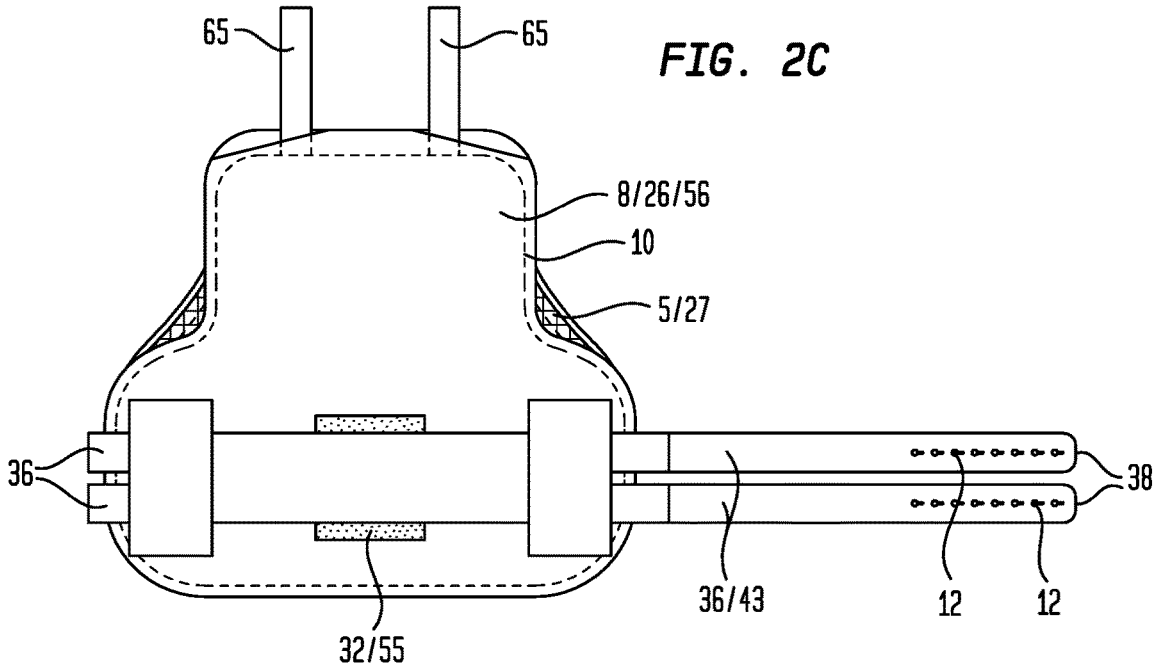
FIG. 2C is a rear view of the particular embodiment of the inventive ballistic-resistant garment shown in FIG. 2B.
Figure 2D:
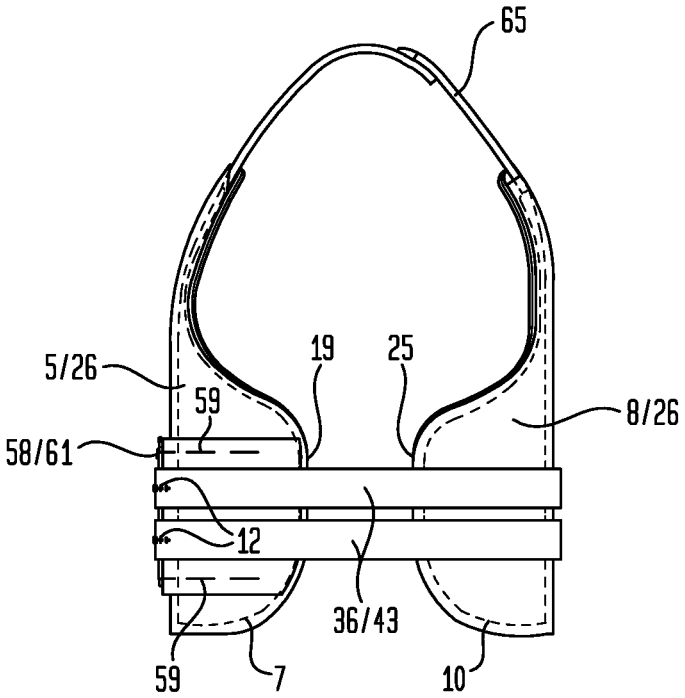
FIG. 2D is a left side view of the particular embodiment of the inventive ballistic-resistant garment shown in FIG. 2B.
Figure 2E:
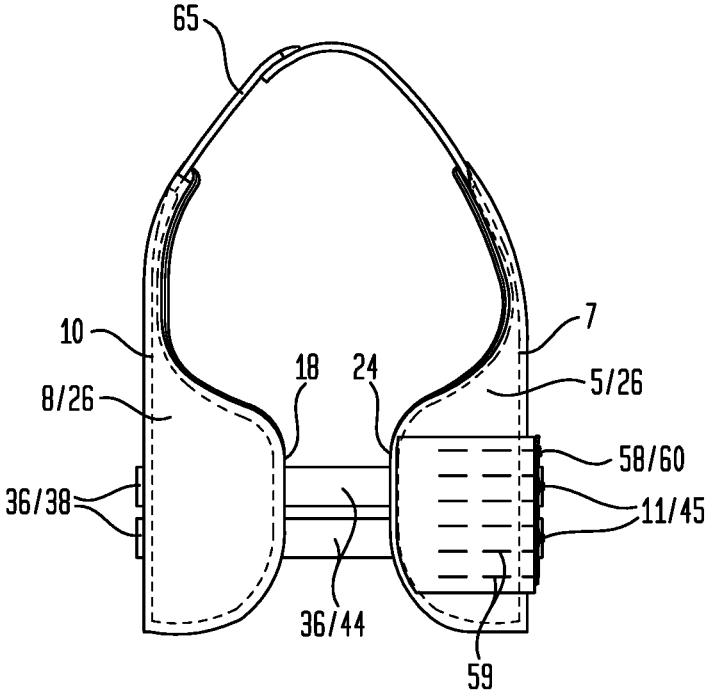
FIG. 2E is a right side view of the particular embodiment of the inventive ballistic-resistant garment shown in FIG. 2B.
Figure 2F:
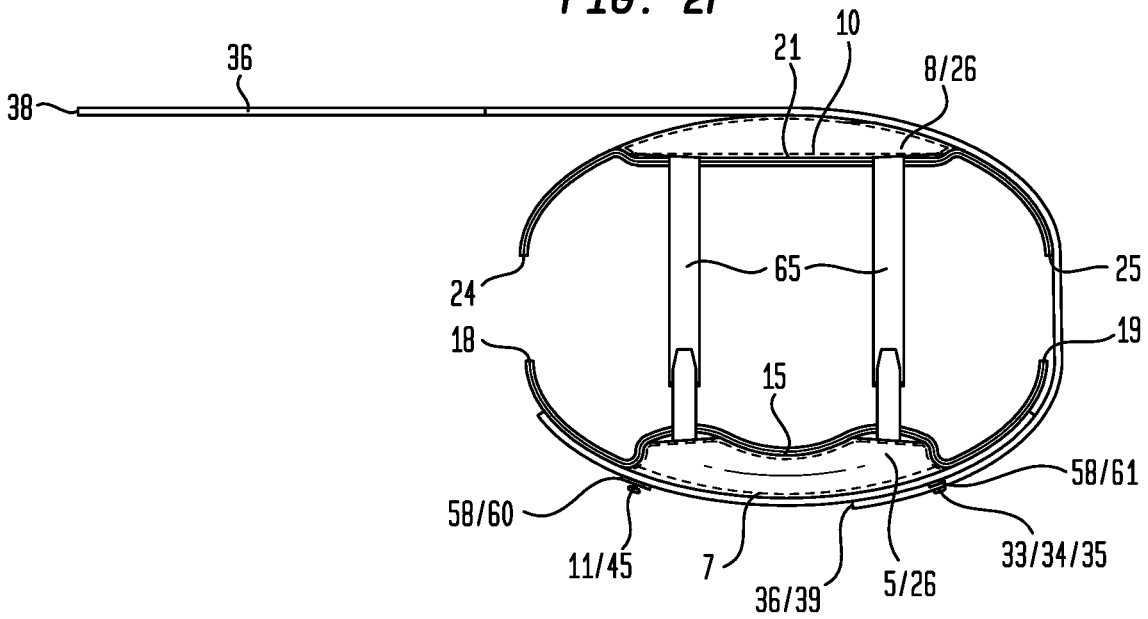
FIG. 2F is a top view of the particular embodiment of the inventive ballistic-resistant garment shown in FIG. 2B.
Figure 2G:
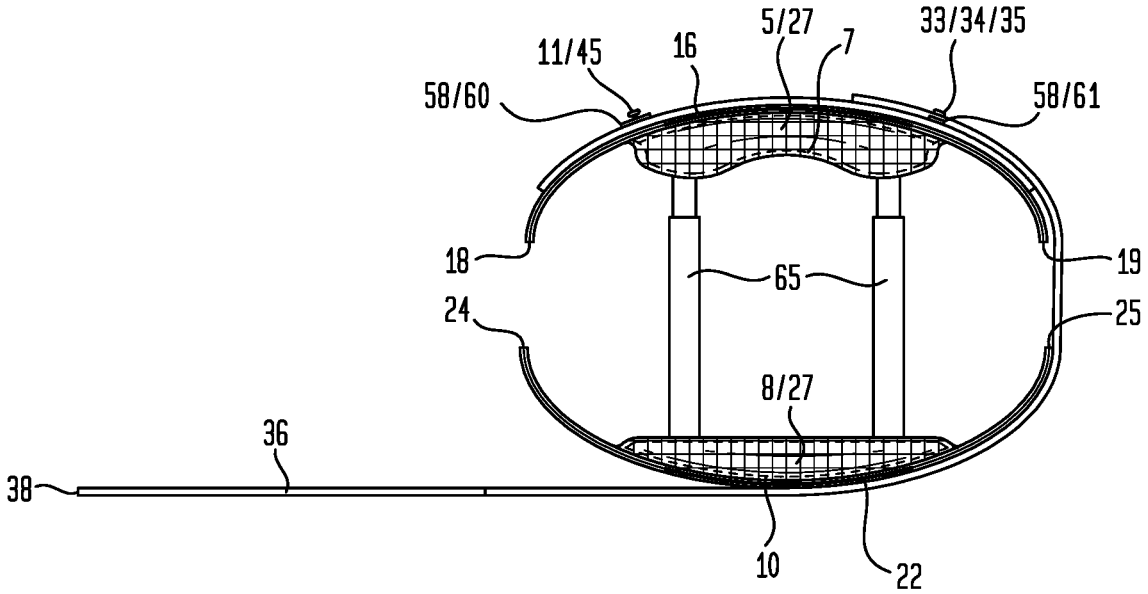
FIG. 2G is a bottom view of the particular embodiment of the inventive ballistic-resistant garment shown in FIG. 2B.

Now referring primarily to FIG. 1, which illustrates a method of using a particular embodiment of the inventive ballistic-resistant garment (1) having an incrementally-adjustable fastening system (2). A wearer (3) can wear the ballistic-resistant garment (1) about a torso (4) to protect the torso (4) from ballistic threats, whereby the ballistic-resistant garment (1) includes a front panel (5) having a front panel pocket (6) configured to receive a first ballistic-resistant insert (7), a back panel (8) having a back panel pocket (9) configured to receive a second ballistic-resistant insert (10), and a front panel first fastener (11) coupled to the front panel (5). The ballistic-resistant garment (1) further includes a plurality of discrete back panel first fasteners (12) coupled in spaced apart relation to the back panel (8), whereby each of the discrete back panel first fasteners (12) is configured to matably engage with the front panel first fastener (11) to provide a first pair of releasably engaged fasteners (13) which couple the front and back panels (5)(8) to fasten the ballistic-resistant garment (1) about the torso (4) of the wearer (3).

The term "torso" for the purposes of this invention means the trunk of a human body, the trunk excluding the head, neck, and limbs. The torso can be divided into a front torso and a back torso, the front torso encompassing the anterior portion of the trunk of the human body, including the chest and the abdomen, the back torso encompassing the posterior portion of the trunk of the human body, including the back.

The term "front" for the purposes of this invention relates to an anterior portion. Correspondingly, the front panel (5) of the ballistic-resistant garment (1) means the portion of the ballistic-resistant garment (1) configured to be worn about the anterior portion of the human body.

The term "back" for the purposes of this invention relates to a posterior portion. Correspondingly, the back panel (8) of the ballistic-resistant garment (1) means the portion of the ballistic-resistant garment (1) configured to be worn about the posterior portion of the human body.

The term "right" for the purposes of this invention means a right portion of a subject, such as a wearer (3), or a portion of a component of the ballistic-resistant garment (1) which would dispose proximate the right portion of the wearer (3) when the wearer (3) wears the ballistic-resistant garment (1).

The term "left" for the purposes of this invention means a left portion of a subject, such as a wearer (3), or a portion of a component of the ballistic-resistant garment (1) which would dispose proximate the left portion of the wearer (3) when the wearer (3) wears the ballistic-resistant garment (1).

The term "pocket" for the purposes of this invention means a receptacle configured to receive or contain one or more ballistic-resistant inserts (7)(10).

The term "ballistic-resistant insert" for the purposes of this invention means a three-dimensionally shaped object, whether flat or contoured, which can have any applicable perimeter shape, whether regular or irregular, which can be capable of slowing or stopping one or more insults, such as a high velocity projectile, for example via one or more energy-absorbing mechanisms. The ballistic resistant insert (7)(8) can be generally rigid, semi-rigid, flexible, or combinations thereof, depending upon the application.

Figure 3A:
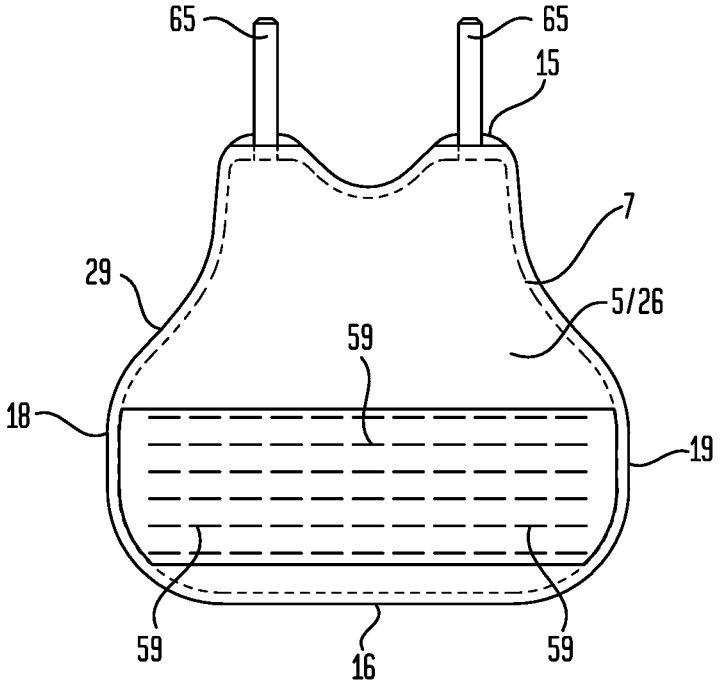
FIG. 3A is a front view of a particular embodiment of a front panel of the inventive ballistic-resistant garment.
Figure 3B:
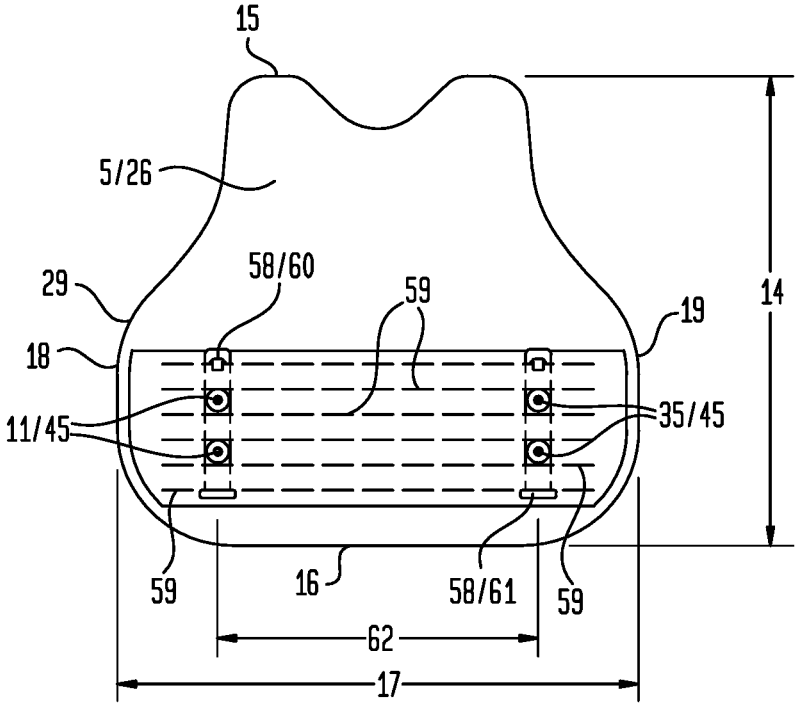
FIG. 3B is a front view of a particular embodiment of a front panel of the inventive ballistic-resistant garment, whereby front panel fasteners are fixedly coupled to elongate connectors which are slidably engaged with slits disposed in the front panel.
Figure 3C:
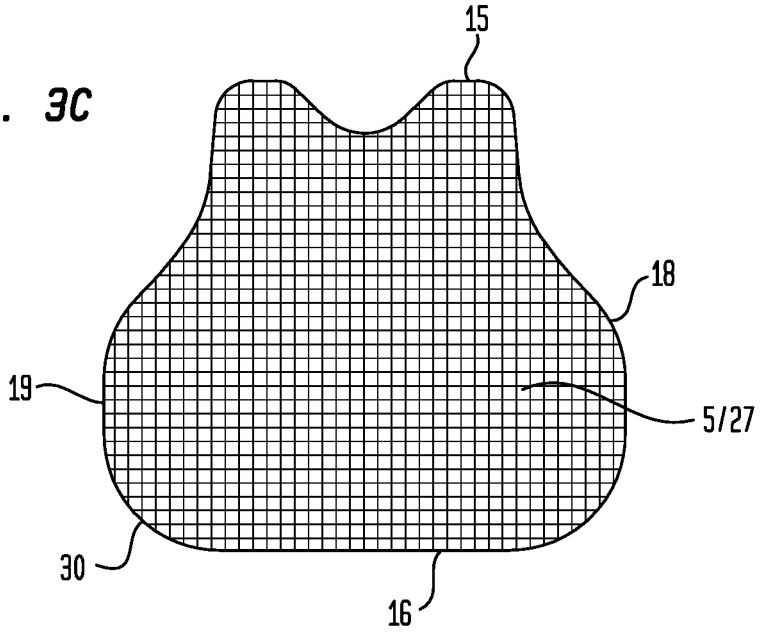
FIG. 3C is a rear view of the particular embodiment of the front panel shown in FIG. 3B.
Figure 3E:
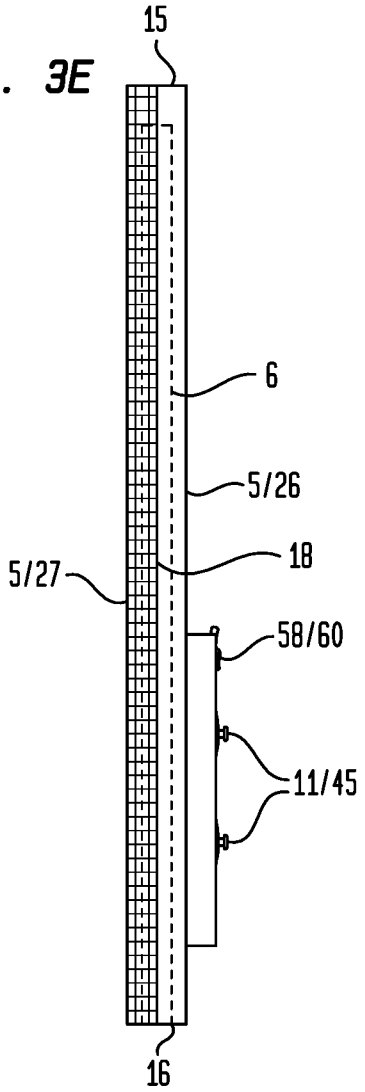
FIG. 3E is a right side view of the particular embodiment of the front panel shown in FIG. 3B.
Figure 3D:
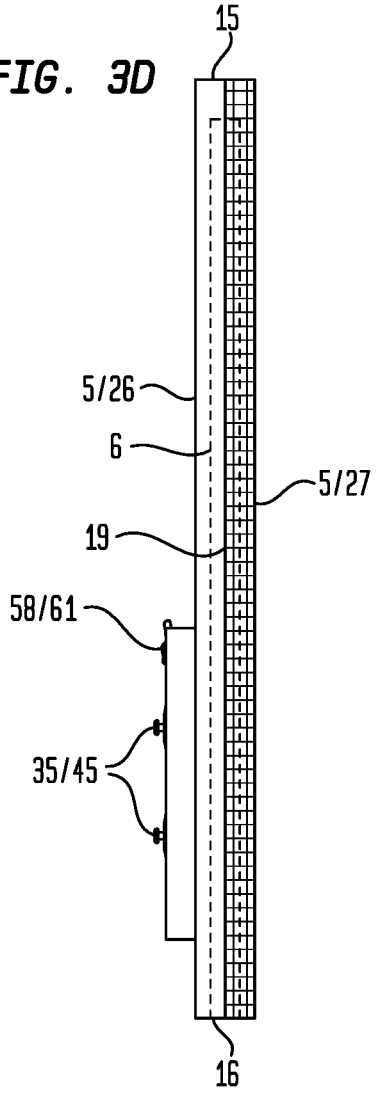
FIG. 3D is a left side view of the particular embodiment of the front panel shown in FIG. 3B.
Figure 3F:
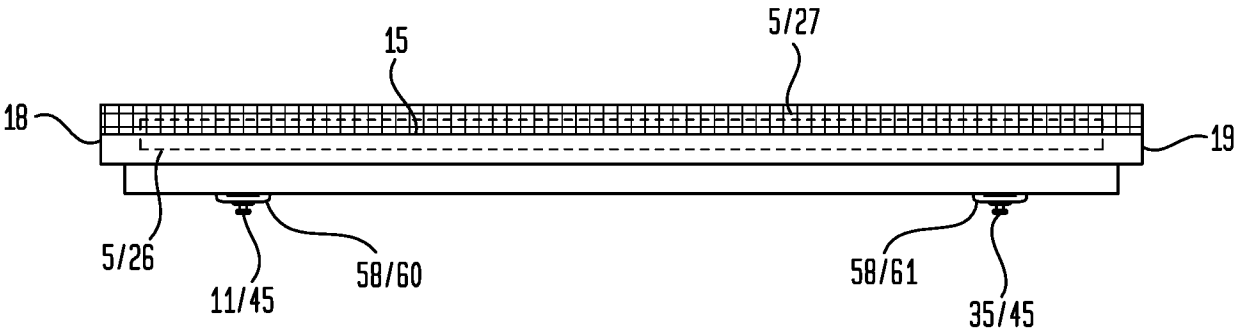
FIG. 3F is a top view of the particular embodiment of the front panel shown in FIG. 3B.
Figure 3G:
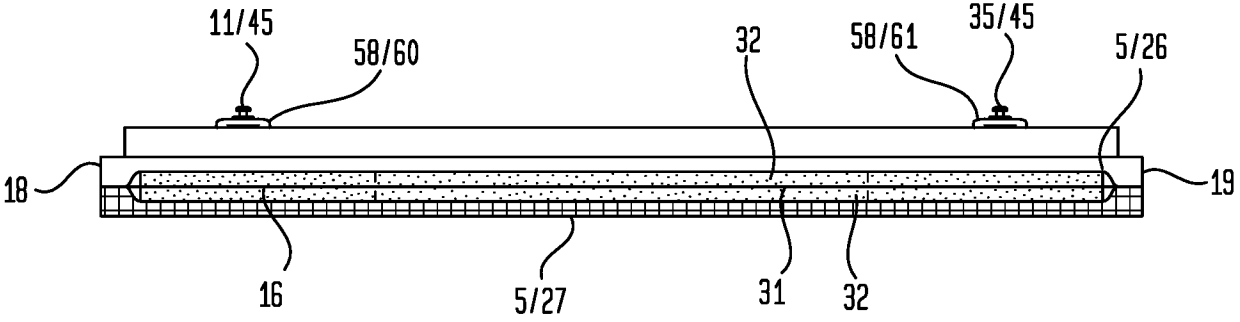
FIG. 3G is a bottom view of the particular embodiment of the front panel shown in FIG. 3B.

Now referring primarily to FIG. 3A through FIG. 3G, the ballistic-resistant garment (1) includes a front panel (5) configured to be worn about a front torso of a wearer (3), whereby the front panel (5) has a front panel length (14) extending between opposing front panel upper and lower ends (15)(16) and a front panel width (17) extending between opposing front panel right and left sides (18)(19) (as shown in the example of FIG. 3B). Each of the front panel length and width (14)(17) can have any of a numerous and wide variety of dimensional relations provided that in combination, the dimensional relations are such that the front panel length and width (14)(17) sufficiently cover the front torso of the wearer (3), whether partially or completely.

Figures 4A, 4B:
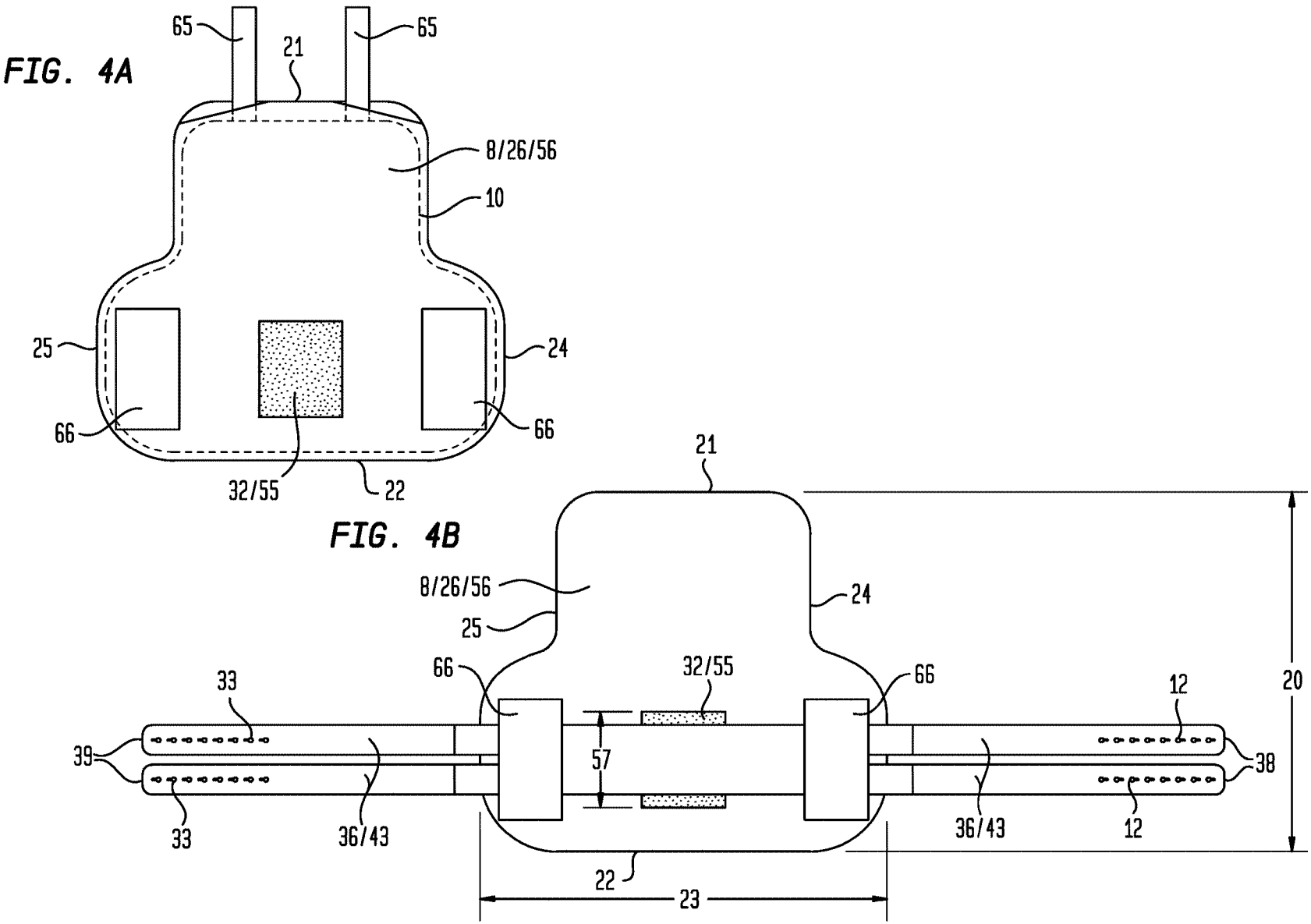
FIG. 4A is a front view of a particular embodiment of a back panel of the inventive ballistic-resistant garment.
FIG. 4B is a front view of a particular embodiment of a back panel of the inventive ballistic-resistant garment, whereby an elongate member is coupled to the back panel and a plurality of discrete back panel fasteners are coupled in spaced apart relation to the elongate member proximate opposing elongate member ends.
Figure 4C:
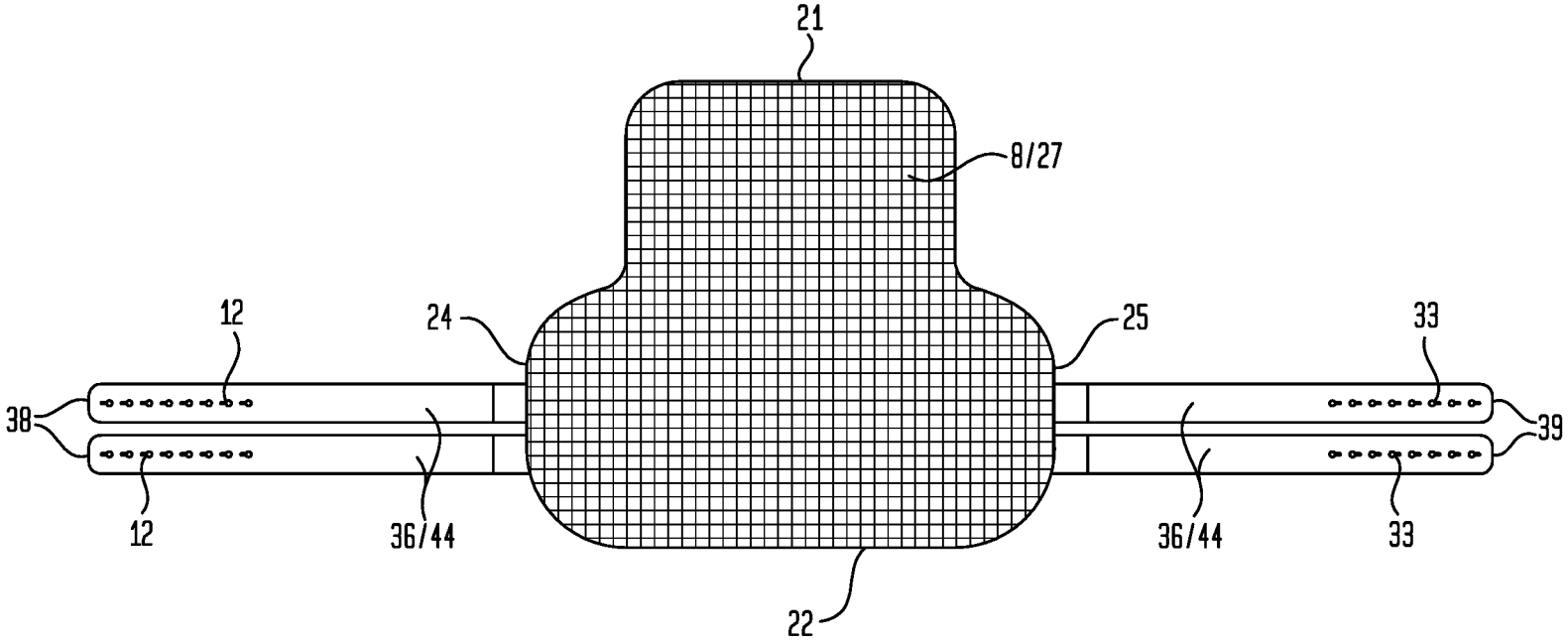
FIG. 4C is a rear view of the particular embodiment of the back panel shown in FIG. 4B.
Figure 4D:
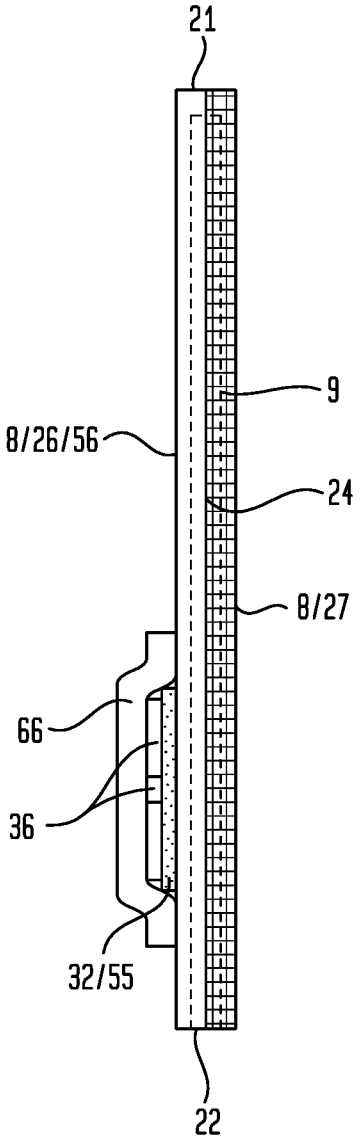
FIG. 4D is a right side view of the particular embodiment of the back panel shown in FIG. 4B.
Figure 4E:
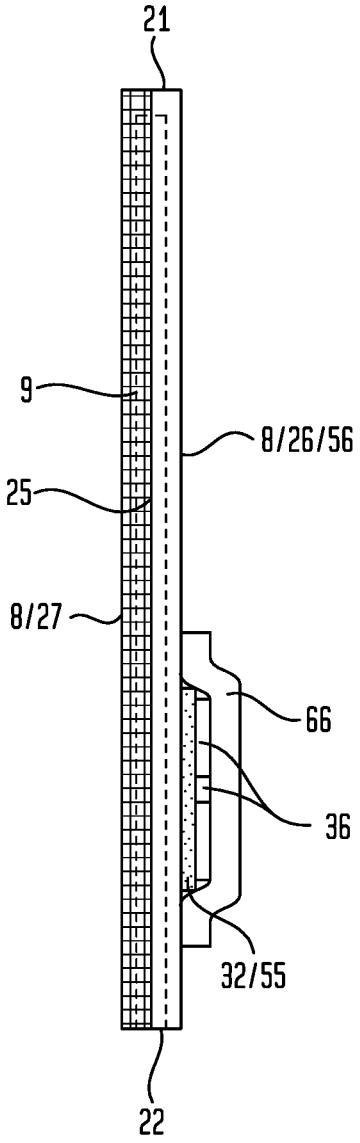
FIG. 4E is a left side view of the particular embodiment of the back panel shown in FIG. 4B.
Figure 4F:
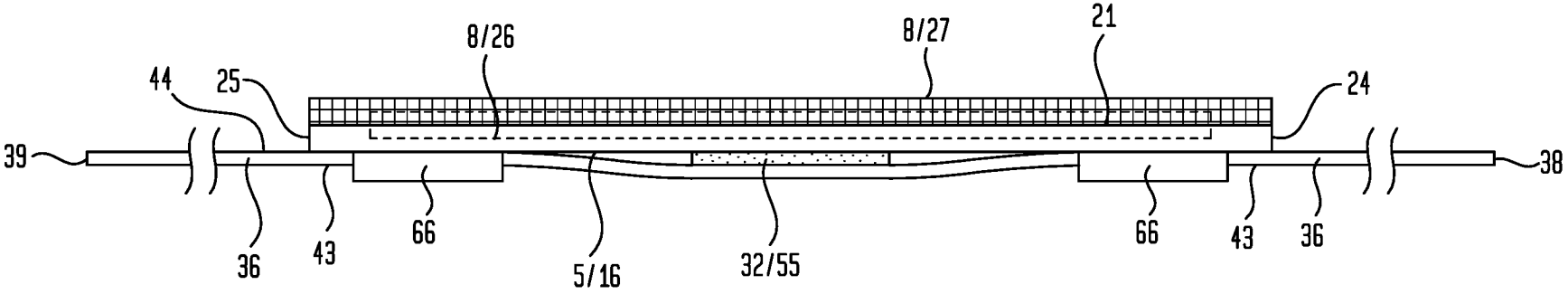
FIG. 4F is a top view of the particular embodiment of the back panel shown in FIG. 4B.
Figure 4G:
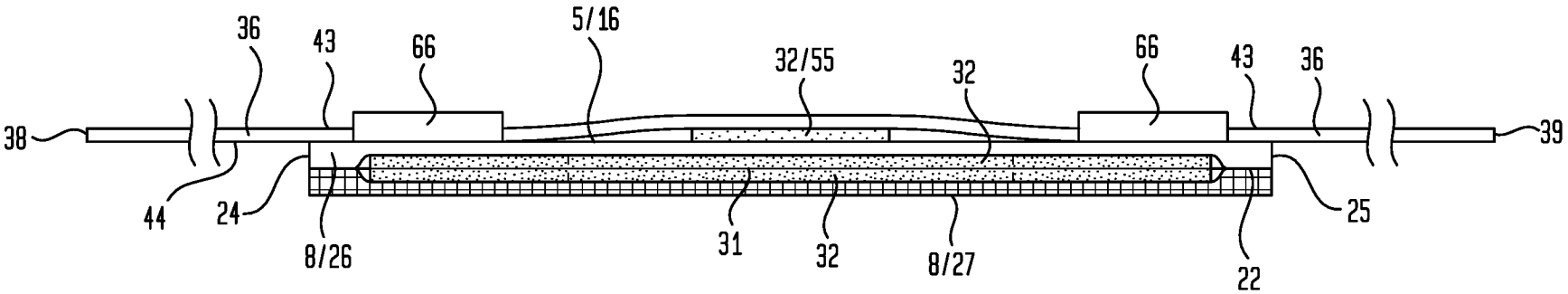
FIG. 4G is a bottom view of the particular embodiment of the back panel shown in FIG. 4B.
Figure 5A:
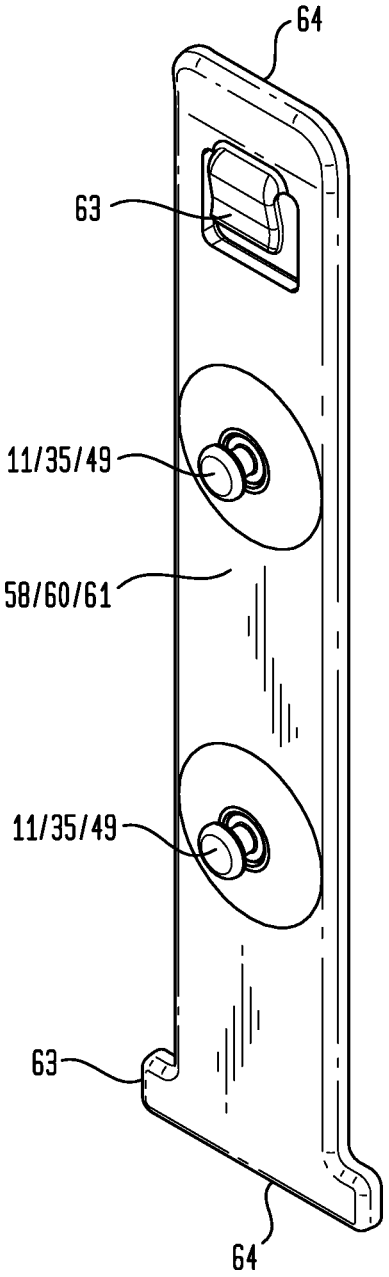
FIG. 5A is a perspective view of a front of a particular embodiment of an elongate connector of the inventive ballistic-resistant garment, whereby a pair of front panel fasteners are fixedly coupled to the elongate connector.
Figure 5B:
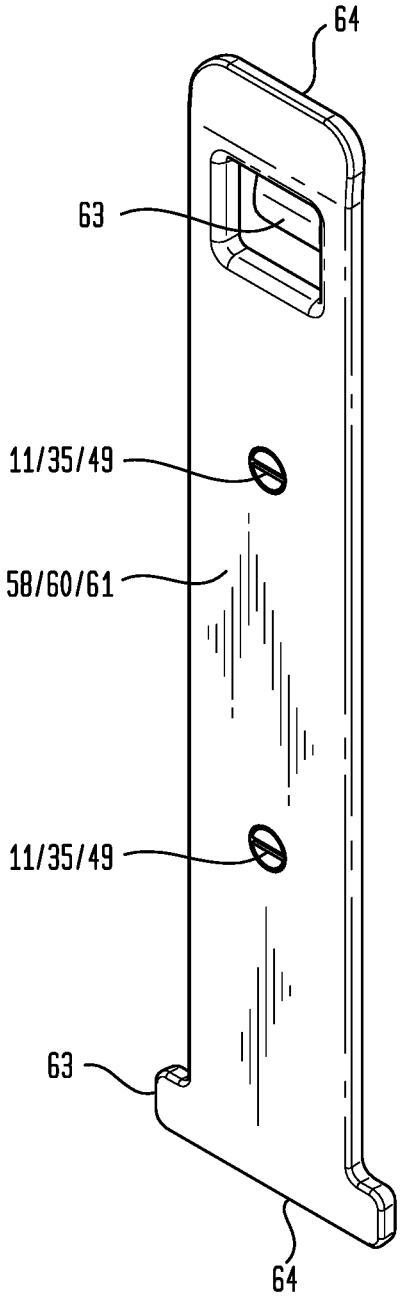
FIG. 5B is a perspective view of a back of the elongate connector shown in FIG. 5A.
Figures 5C, 5E, 5F:
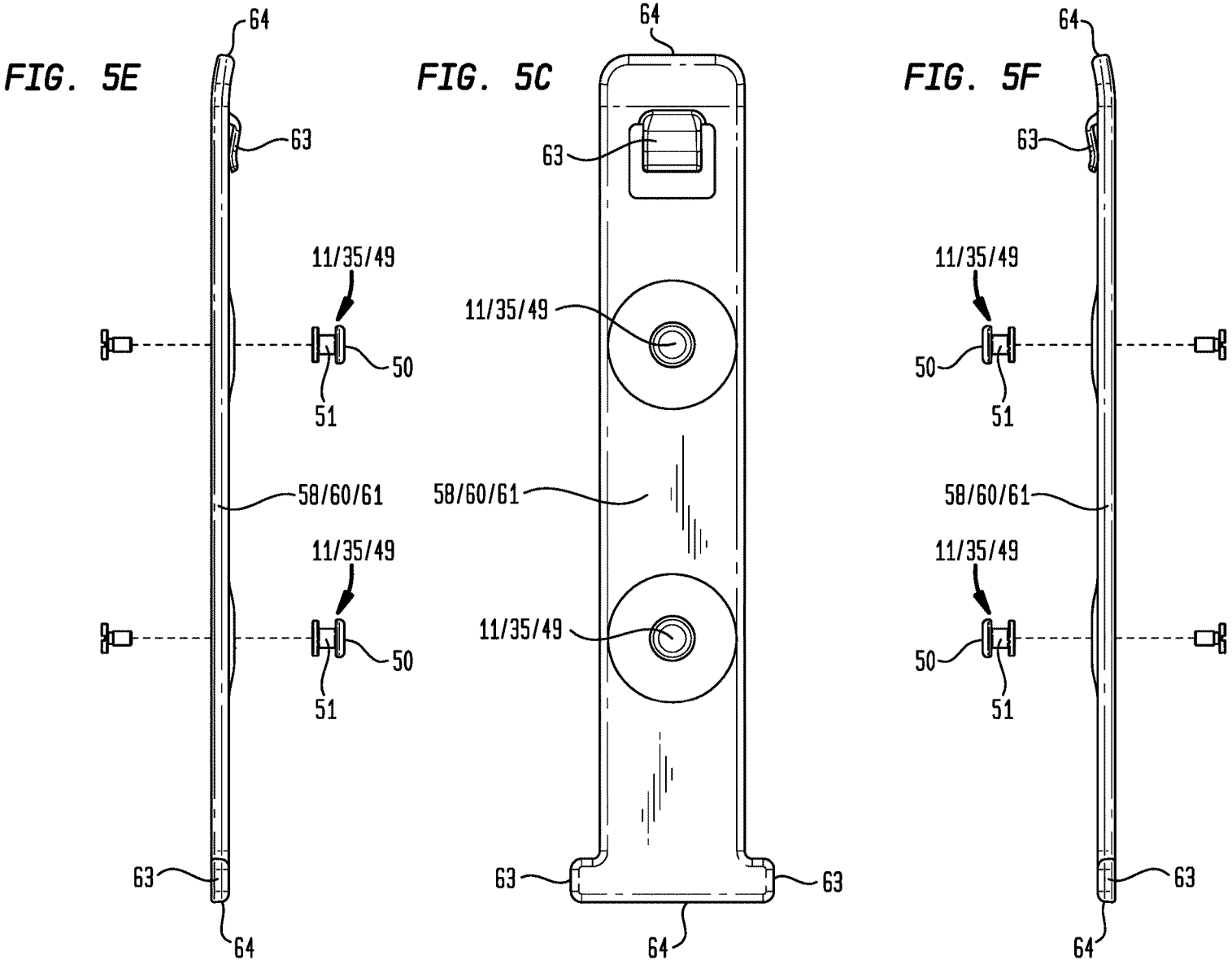
FIG. 5C is a front view of the elongate connector shown in FIG. 5A.
FIG. 5E is a right side view of the elongate connector shown in FIG. 5A, but whereby the front panel fasteners are outwardly exploded from the elongate connector.
FIG. 5F is a left side view of the elongate connector shown in FIG. 5A, but whereby the front panel fasteners are outwardly exploded from the elongate connector.
Figure 5G:
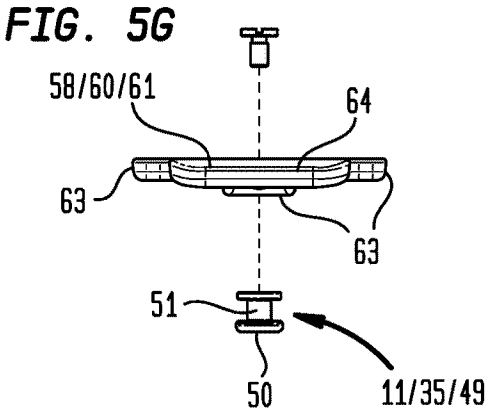
FIG. 5G is a top view of the elongate connector shown in FIG. 5A, but whereby the front panel fasteners are outwardly exploded from the elongate connector.
Figure 5H:
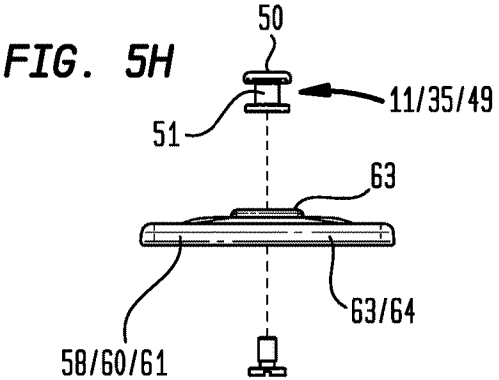
FIG. 5H is a bottom view of the elongate connector shown in FIG. 5A, but whereby the front panel fasteners are outwardly exploded from the elongate connector.
Figure 5D:
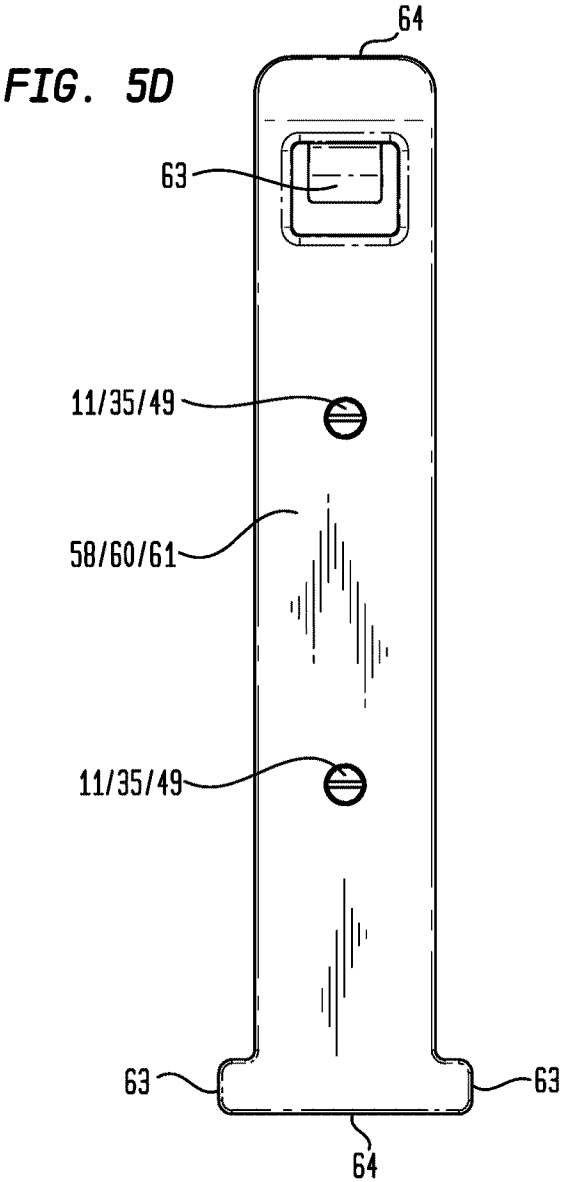
FIG. 5D is a rear view of the elongate connector shown in FIG. 5A.

Now referring primarily to FIG. 4A through FIG. 4G and akin to the front panel (5), the ballistic-resistant garment (1) further includes a back panel (8) configured to be worn about a back torso of a wearer (3), whereby the back panel (8) has a back panel length (20) extending between opposing back panel upper and lower ends (21)(22) and a back panel width (23) extending between opposing back panel right and left sides (24)(25) (as shown in the example of FIG. 4B). Each of the back panel length and width (20)(23) can have any of a numerous and wide variety of dimensional relations provided that in combination, the dimensional relations are such that the back panel length and width (20)(23) sufficiently cover the back torso of the wearer (3), whether partially or completely.

As to particular embodiments, the front and back panels (5)(8) can together form a vest-like ballistic resistant garment (1), which can be generally sleeveless (as shown in the examples of the Figures); however, the invention need not be limited to this configuration.

Now referring primarily to FIG. 3A through FIG. 4G, each of the front and back panels (5)(8) has a corresponding front or back panel pocket (6)(9) configured to receive a corresponding first or second ballistic-resistant insert (7)(10).

Again referring primarily to FIG. 3A through FIG. 4G, as to particular embodiments, each panel (5)(8) can be configured from first and second materials (26)(27) disposed in overlaying engagement to form the pocket (6)(9) which defines a pocket interior space therebetween. Accordingly, the first and second materials (26)(27) can be coupled proximate corresponding first and second material peripheries (29)(30) except proximate a pocket opening (31) through which a ballistic-resistant insert (7)(10) can be passed for receipt within the pocket interior space.

Again referring primarily to FIG. 3A through FIG. 4G, as to particular embodiments, the first and second materials (26)(27) can be coupled proximate corresponding first and second material peripheries (29)(30) which extend along the panel upper end (15)(21) and the panel right and left sides (18)(24)(19)(25) to dispose the pocket opening (31) proximate the panel lower end (16)(22).

To secure one or more ballistic-resistant inserts (7)(10) within the pocket interior space, a securement system (32) can be coupled to the first and second materials (26)(27) proximate the pocket opening (31), whereby the securement system (32) can include any of a numerous and wide variety of adhesives or mechanical fasteners, depending upon the application. As but one illustrative example, the first and second materials (26)(27) can be coupled together proximate the pocket opening (31) by a hook and loop securement system (32), whereby one of the hook and loop elements is coupled to the first material (26) proximate the pocket opening (31) and the other of the hook and loop elements is coupled to second material (27) proximate the pocket opening (31).

The first and second materials (26)(27) can be formed from any of a numerous and wide variety of fabrics or fabric-like materials, whether woven or non-woven, depending upon the application. As but one illustrative example, the first material (26), which can outwardly dispose when the ballistic-resistant garment (1) is worn about the torso (4) of the wearer (3), can be a flexible, durable, stain-resistant fabric, such as polyester; and, the second material (27), which can inwardly dispose when the ballistic-resistant garment (1) is worn about the torso (4) of the wearer (3), can be a breathable fabric, such as mesh or mesh-like fabric, which, as to particular embodiments, can also have antimicrobial properties.

Now referring primarily to FIG. 2A through FIG. 2G, FIG. 3B through FIG. 3G, and FIG. 4B through FIG. 4G, the ballistic-resistant garment (1) further includes a front panel first fastener (11) coupled to the front panel (5); and a plurality of discrete back panel first fasteners (12) coupled in spaced apart relation to the back panel (8), whereby each of the discrete back panel first fasteners (12) is configured to matably engage with the front panel first fastener (11) to provide a first pair of releasably engaged fasteners (13) which couple the front and back panels (5)(8) to fasten the ballistic-resistant garment (1) about the torso (4) of the wearer (3).

Now referring primarily to FIG. 2A through FIG. 2G, and FIG. 4B through FIG. 4G, the ballistic-resistant garment (1) can, but need not necessarily, further include a plurality of discrete back panel second fasteners (33) coupled in spaced apart relation to the back panel (8), whereby each of the discrete back panel second fasteners (33) is configured to matably engage with the front panel first fastener (11) to provide a second pair of releasably engaged fasteners (34) which couple the front and back panels (5)(8) to fasten the ballistic-resistant garment (1) about the torso (4) of the wearer (3).

As to particular embodiments, the plurality of discrete back panel first fasteners (12) can be coupled in spaced apart relation to the back panel (8) proximate the back panel right side (24) and the plurality of discrete back panel second fasteners (33) can be coupled in spaced apart relation to the back panel (8) proximate the back panel left side (25).

Now referring primarily to FIG. 2A through FIG. 2G, and FIG. 3B through FIG. 3G, the ballistic-resistant garment (1) can, but need not necessarily, further include a front panel second fastener (35) coupled to the front panel (5). Following, each of the discrete back panel first fasteners (12) can be configured to matably engage with the front panel first fastener (11) to provide the first pair of releasably engaged fasteners (13), and each of the discrete back panel second fasteners (33) can be configured to matably engage with the front panel second fastener (35) to provide the second pair of releasably engaged fasteners (34).

As to particular embodiments, the front panel first fastener (11) can be coupled to the front panel (5) proximate the front panel right side (18); thus, one of the plurality of discrete back panel first fasteners (12) coupled in spaced apart relation to the back panel (8) proximate the back panel right side (24) can matably engage with the front panel first fastener (11) to provide the first pair of releasably engaged fasteners (13) which couple the front and back panels (5)(8) to fasten the ballistic-resistant garment (1) about a right side portion of the torso (4) of the wearer (3).

Respectively, the front panel second fastener (35) can be coupled to the front panel (5) proximate the front panel left side (19); thus, one of the plurality of discrete back panel second fasteners (33) coupled in spaced apart relation to the back panel (8) proximate the back panel left side (25) can matably engage with the front panel second fastener (35) to provide the second pair of releasably engaged fasteners (34) which couple the front and back panels (5)(8) to fasten the ballistic-resistant garment (1) about a left side portion of the torso (4) of the wearer (3).

Now referring primarily to FIG. 2A through FIG. 2G, FIG. 4B through FIG. 4G, FIG. 6A, and FIG. 6B, the ballistic-resistant garment (1) can, but need not necessarily, further include an elongate member (36) coupled to the back panel (8), the elongate member (36) having an elongate member length (37) disposed between opposing elongate member right and left ends (38)(39), whereby the plurality of discrete back panel first fasteners (12) can be coupled in generally horizontal spaced apart relation to the elongate member (36) proximate the elongate member right end (38) and whereby the plurality of discrete back panel second fasteners (33) can be coupled in generally horizontal spaced apart relation to the elongate member (36) proximate the elongate member left end (39).

As to particular embodiments having the front panel first fastener (11) coupled to the front panel (5) proximate the front panel right side (18) and the plurality of discrete back panel first fasteners (11) coupled in generally horizontal spaced apart relation to the elongate member (36) proximate the elongate member right end (38), one of the plurality of discrete back panel first fasteners (12) can matably engage with the front panel first fastener (11) to provide the first pair of releasably engaged fasteners (13) which couple the front and back panels (5)(8) to fasten the ballistic-resistant garment (1) about a right side portion of the torso (4) of the wearer (3).

Similarly, as to particular embodiments having the front panel second fastener (35) coupled to the front panel (5) proximate the front panel left side (19) and the plurality of discrete back panel second fasteners (33) coupled in generally horizontal spaced apart relation to the elongate member (36) proximate the elongate member left end (39), one of the plurality of discrete back panel second fasteners (33) can matably engage with the front panel second fastener (35) to provide the second pair of releasably engaged fasteners (34) which couple the front and back panels (5)(8) to fasten the ballistic-resistant garment (1) about a left side portion of the torso (4) of the wearer (3).

Now referring primarily to FIG. 6C and FIG. 8, upon matable engagement to provide the first and second pair of releasably engaged fasteners (13)(34), the elongate member (36) couples to the front panel (5) to have a coupled elongate member length (40) between the back panel first fastener (12) which is matably engaged with the front panel first fastener (11) and the back panel second fastener (33) which is matably engaged with the front panel second fastener (35).

A lesser coupled elongate member length (40) can be achieved by matably engaging back panel first and second fasteners (12)(33) which dispose a lesser distance apart along the elongate member length (37) with corresponding front panel first and second fasteners (11)(35), in relation to matably engaging back panel first and second fasteners (12)(33) which dispose a greater distance apart along the elongate member length (37) with corresponding front panel first and second fasteners (11)(35), whereby the lesser coupled elongate member length (40) may be useful for customizing the fit of the ballistic-resistant garment (1) for a wearer (3) with lesser torso dimensional relations, such as a lesser distance encircling the torso (4), versus a wearer (3) with greater torso dimensional relations.

Likewise, a greater coupled elongate member length (40) can be achieved by matably engaging back panel first and second fasteners (12)(33) which dispose a greater distance apart along the elongate member length (27) with corresponding front panel first and second fasteners (11)(35), in relation to matably engaging back panel first and second fasteners (12)(33) which dispose a lesser distance apart along the elongate member length (37) with corresponding front panel first and second fasteners (11)(35), whereby the greater coupled elongate member length (40) may be useful for customizing the fit of the ballistic-resistant garment (1) for a wearer (3) with greater torso dimensional relations, such as a greater distance encircling the torso (4), versus a wearer (3) with lesser torso dimensional relations.

Upon customization of the fit of the ballistic-resistant garment (1) via use of the incrementally-adjustable fastening system (2), the wearer (3) can note the particular back panel first and second fasteners (12)(33) which matably engage with corresponding front panel first and second fasteners (11)(35) to provide the customized fit. Following, upon wearing the ballistic-resistant garment (1) again, the wearer (3) can achieve a repeatable fit by matably engaging the noted back panel first and second fasteners (12)(33) with corresponding front panel first and second fasteners (11)(35), thereby duplicating the customized fit without having to conjecture regarding the fit and consequently, having to potentially readjust the fit multiple times, as may be mandated by non-incremental or continuous conventional fastening systems, such as hook and loop fastening systems.

As to particular embodiments, the elongate member (36) can, but need not necessarily, be provided as a pair elongate members (36), each of the pair of elongate members (36) having opposing elongate member right and left ends (38)(39), whereby each of the pair of elongate members (36) can be discretely adjusted to provide pairs of releasably engaged fasteners (13)(34). Following, the pair of elongate member right ends (38) may or may not vertically align with one another, depending upon the discrete adjustment of each of the pair of elongate members (36). Likewise, the pair of elongate member left ends (39) may or may not vertically align with one another, depending upon the discrete adjustment of each of the pair of elongate members (36).

Each of the back panel fasteners (12)(33) can be configured as any of a numerous and wide variety of discrete fasteners which can matably engage with a front panel fastener (11)(35) to provide a pair of releasably engaged fasteners (13)(34).

Now referring primarily to FIG. 2A through FIG. 2G, FIG. 4B through FIG. 4G, FIG. 6A through FIG. 6E, and FIG. 8, as but one illustrative example, the back panel fasteners (12)(33) can be configured as aperture elements (41) which dispose in generally horizontal spaced apart relation in the elongate member (36) proximate the elongate member ends (38)(39), whereby each aperture element (41) defines an aperture element opening (42) which communicates between opposing elongate member outer and inner surfaces (43)(44). Correspondingly, each front panel fastener (11)(35) can be configured as a mating protrusion (45) which can be received within the aperture element opening (42) to provide the pair of releasably engaged fasteners (13)(34).

Now referring primarily to FIG. 6D and FIG. 6E, as to particular embodiments, each aperture element opening (42) can be in communication with a slot opening (46) defined by a slot (47), whereby the slot opening (46) also communicates between opposing elongate member outer and inner surfaces (43)(44). Additionally, the slot opening (46) has a slot opening width (48) which has lesser dimensional relations than the aperture element opening (42).

The material in which the aperture elements (41) and the slots (47) are disposed can be any of a numerous and wide variety of fabrics or fabric-like materials, whether woven or non-woven, depending upon the application. As but one illustrative example, the material can be a flexible, durable fabric, such as chlorosulfonated polyethylene (CSPE) synthetic rubber (CSM) (52) or a similar elastomer, with like physical and mechanical properties, chemical resistance, thermal properties, and/or environmental performance.

Accordingly, as to particular embodiments, portions of the elongate member (36) proximate the elongate member ends (38)(39) in which the aperture elements (41) and the slots (47) dispose in generally horizontal spaced apart relation can be formed from CSM (52), although as to other particular embodiments, the entirety of the elongate member (36) can be formed from CSM.

Referring to the former embodiments described directly above, the elongate member (36) can additionally be formed from a resiliently stretchable material (53) to further enhance the fit of the ballistic-resistant garment (1) about the torso (4) of the wearer (3) as well as to enhance the mobility of the wearer (3). As but one illustrative example, the portions of the elongate member (36) proximate the elongate member ends (38)(39) in which the aperture elements (41) and the slots (47) dispose in generally horizontal spaced apart relation can be formed from CSM (52) and the portions of the elongate member (36) inwardly adjacent to each of the elongate member ends (38)(39) can be formed from the resiliently stretchable material (53).

Now referring primarily to FIG. 4A through FIG. 4G, as to particular embodiments, the elongate member (36) can removably couple to the back panel (8), such as by any of a numerous and wide variety of adhesives or mechanical fasteners, depending upon the application. As but one illustrative example, the elongate member (36) can couple to the back panel (8) via a hook and loop securement system (32), whereby one of the hook and loop elements (54) is coupled to the elongate member inner surface (44) and the other of the hook and loop elements (55) is coupled to a back panel outer surface (56).

Now referring primarily to FIG. 4B, as to particular embodiments, the height (57) of the hook and loop element (55) coupled to the back panel outer surface (56) can be greater than the width of the elongate member (36). Thus, the elongate member (36) can adjustably couple to the back panel (8) along the height (57) of the hook and loop element (55) coupled to the back panel outer surface (56) and, correspondingly, can adjustably couple to the back panel (8) along a portion of the back panel length (20).

Now referring primarily to FIG. 2A through FIG. 2G, FIG. 3B through FIG. 3G, FIG. 5A through FIG. 5H, and FIG. 7A through FIG. 7H, as to particular embodiments whereby the back panel fasteners (12)(33) are configured as communicating aperture elements (41) and slots (47) which dispose in generally horizontal spaced apart relation in the elongate member (36) proximate the elongate member ends (38)(39) (as described above), each front panel fastener (11)(35) can be configured as a mating protrusion (45) which can be received within the corresponding aperture element opening (42) and slot opening (46) to provide a pair of releasably engaged fasteners (13)(34).

Again referring primarily to FIG. 2A through FIG. 2G, FIG. 3B through FIG. 3G, FIG. 5A through FIG. 5H, and FIG. 7A through FIG. 7H, as but one illustrative example, the protrusion (45) can be configured as a headed pin (49) having a head (50) outwardly extending from a shank (51) which couples to the front panel (5), whereby the circumference of the head (50) is greater than the circumference of the shank (51), thereby facilitating functioning of the head (50) as a stop element.

Following, for matable engagement of the headed pin (49) with the slot (47), the head (50) can be passed through the aperture element opening (42) in a first direction so that the shank (51) can be received within the aperture element opening (42). Further, the shank (51) can then be passed from the aperture element opening (42) to the slot opening (46) whereby, upon receipt within the slot opening (46), the head (50) can engage with the slot (47) to stop the head (50) from passing through the slot opening (46) and thus, matably engaging the headed pin (49) with the slot (47) to provide a pair of releasably engaged fasteners (13)(34).

For disengagement of the pair of releasably engaged fasteners (13)(34), the shank (51) can be passed from the slot opening (46) to the aperture element opening (42). Following, the head (50) can be passed through the aperture element opening (42) in a second direction which opposes the first direction.

Again referring primarily to FIG. 2A through FIG. 2G, FIG. 3B through FIG. 3G, and FIG. 5A through FIG. 5H, as to particular embodiments, each front panel fastener (11)(35), such as a headed pin (49), can be adjustably coupled to the front panel (5) such that the front panel fastener (11)(35) can be adjustably positioned along the front panel width (17) and, as to particular embodiments, also along the front panel length (14).

Now referring primarily to FIG. 5A through FIG. 5H, and FIG. 7A through FIG. 7H, as to particular embodiments, the front panel fastener (11)(13) can be fixedly coupled to a connector (58), whereby the connector (58) can be configured to adjustably couple to the front panel (5). As but one illustrative example, the connector (58) can be an elongate connector (58) configured for slidable engagement with a slit (59) disposed in the front panel (5).

Now referring primarily to FIG. 2A through FIG. 2G, and FIG. 3A through FIG. 3H, a plurality of slits (59) can be disposed in generally horizontal spaced apart relation in the front panel (5) along the front panel width (17). Accordingly, a front panel first fastener (11) can be fixedly coupled to a first elongate connector (60), whereby the first elongate connector (60) can be adjustably coupled to the front panel (5) along the front panel width (17) by slidable engagement with a slit (59) disposed proximate the front panel right side (18). Thus, one of the plurality of discrete back panel first fasteners (12) coupled in spaced apart relation to the back panel (8) proximate the back panel right side (24) can matably engage with the front panel first fastener (11) to provide the first pair of releasably engaged fasteners (13) which couple the front and back panels (5)(8) to fasten the ballistic-resistant garment (1) about a right side portion of the torso (4) of the wearer (3).

Respectively, a front panel second fastener (35) can be fixedly coupled to a second elongate connector (61), whereby the second elongate connector (61) can be adjustably coupled to the front panel (5) along the front panel width (17) by slidable engagement with a slit (59) disposed proximate the front panel left side (19). Thus, one of the plurality of discrete back panel second fasteners (33) coupled in spaced apart relation to the back panel (8) proximate the back panel left side (25) can matably engage with the front panel second fastener (35) to provide the second pair of releasably engaged fasteners (34) which couple the front and back panels (5)(8) to fasten the ballistic-resistant garment (1) about a left side portion of the torso (4) of the wearer (3).

Now referring primarily to FIG. 3B, upon matable engagement to provide the first and second pair of releasably engaged fasteners (13)(34), the first and second elongate connectors (60)(61) can dispose a distance (62) apart along the front panel width (17). A lesser distance (62) may be useful for customizing the fit of the ballistic-resistant garment (1) for a wearer (3) with lesser torso dimensional relations, such as a lesser distance encircling the torso (4), versus a wearer (3) with greater torso dimensional relations. Conversely, a greater distance (62) may be useful for customizing the fit of the ballistic-resistant garment (1) for a wearer (3) with greater torso dimensional relations, such as a greater distance encircling the torso (4), versus a wearer (3) with lesser torso dimensional relations.

Now referring primarily to FIG. 2A through FIG. 2G, and FIG. 3A through FIG. 3H, as to particular embodiments, a plurality of slits (59) can also be disposed in generally vertical spaced apart relation in the front panel (5) along the front panel length (14). Accordingly, the elongate connector (60)(61) and correspondingly, the front panel fastener (11)(35) can be adjustably coupled to the front panel (5) along the front panel length (14).

Additionally, the elongate connector (60)(61) can be woven through a plurality of vertically-aligned slits (59) for an enhanced connection with the front panel (5).

Now referring primarily to FIG. 5A through FIG. 5H, and FIG. 7A through FIG. 7H, as but one illustrative example, the elongate connector (60)(61) can be configured to have at least one clip (63), clip-like element (63), hook (63), hook-like element (63), or the like, proximate an elongate connector end (64), which can function as a stop element, thereby stopping that elongate connector end (64) from passing through the slit (59).

Now referring primarily to FIG. 7A through FIG. 7H, as to particular embodiments, only one front panel fastener (11)(35) can be coupled to the elongate connector (60)(61).

Now referring primarily to FIG. 5A through FIG. 5H, as to other particular embodiments, two or more front panel fasteners (11)(35) can be coupled to the elongate connector (60)(61).

Now referring primarily to FIG. 1, FIG. 3A, and FIG. 4A, as to particular embodiments, the ballistic-resistant garment (1) can, but need not necessarily, further include a pair of strap elements (65) which couple the front and back panels (5)(8) together proximate the corresponding front and back panel upper ends (15)(22).

As to particular embodiments, the pair of strap elements (65) can connect to the ballistic-resistant insert (7)(10) received within the pocket (6)(9), which may be helpful for load-bearing weight distribution.

Now referring primarily to FIG. 4A, FIG. 4B, and FIG. 4D through FIG. 4G, as to particular embodiments, the ballistic-resistant garment (1) can, but need not necessarily, further include a support loop (66) coupled to the back panel (8) proximate the back panel outer surface (56), whereby the support loop (66) can be configured to support a portion of the elongate member (36). Further, the support loop (66) can function to preclude the elongate member (36) from vertical movement along the back panel length (20).

A method of making the ballistic-resistant garment (1) having an incrementally-adjustable fastening system (2) includes providing a front panel (5) having a front panel pocket (6) configured to receive a first ballistic-resistant insert (7); providing a back panel (8) having a back panel pocket (9) configured to receive a second ballistic-resistant insert (10), and coupling a front panel first fastener (11) to the front panel (5). The method further includes coupling a plurality of discrete back panel first fasteners (12) in spaced apart relation to the back panel (8), whereby each of the discrete back panel first fasteners (12) is configured to matably engage with the front panel first fastener (11) to provide a first pair of releasably engaged fasteners (13) which couple the front and back panels (5)(8) to fasten the ballistic-resistant garment (1) about the torso (4) of the wearer (3).

The method of making the ballistic-resistant garment (1) having the incrementally-adjustable fastening system (2) can further include providing additional components of the ballistic-resistant garment (1) as described above.

As can be easily understood from the foregoing, the basic concepts of the present invention may be embodied in a variety of ways. The invention involves numerous and varied embodiments of a ballistic-resistant garment and methods for making and using such a ballistic-resistant garment, including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "fastener" should be understood to encompass disclosure of the act of "fastening"—whether explicitly discussed or not—and, conversely, were there effectively disclosure of the act of "fastening", such a disclosure should be understood to encompass disclosure of a "fastener" and even a "means for fastening". Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a wearer (2) of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the ballistic-resistant garments herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application, if any, provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

We claim:

1. A ballistic-resistant garment, comprising:

a front panel having a front panel pocket configured to receive a first ballistic-resistant plate;

a front panel first fastener coupled to said front panel;

a front panel second fastener coupled to said front panel;

a back panel having a back panel pocket configured to receive a second ballistic-resistant plate;

an elongate member coupled to said back panel, said elongate member having an elongate member length disposed between opposing elongate member right and left ends;

a plurality of discrete back panel first fasteners coupled to said elongate member in generally horizontal spaced apart relation proximate said elongate member right end, each of said back panel first fasteners configured to matably engage with said front panel first fastener to provide a first pair of releasably engaged fasteners which couple said front and back panels to fasten said ballistic-resistant garment about a torso of a wearer; and a plurality of discrete back panel second fasteners coupled to said elongate member in generally horizontal spaced apart relation proximate said elongate member left end, each of said back panel second fasteners configured to matably engage with said front panel second fastener to provide a second pair of releasably engaged fasteners which couple said front and back panels to fasten said ballistic-resistant garment about said torso of said wearer;

wherein each of said back panel first and second fasteners comprises an aperture element disposed within said elongate member.

2. The ballistic-resistant garment of claim 1, wherein each said aperture element defines an aperture element opening configured to receive said front panel first or second fastener.

3. The ballistic-resistant garment of claim 2, wherein each of said back panel first and second fasteners further comprises a slot defining a slot opening which communicates with said aperture element opening.

4. The ballistic-resistant garment of claim 2, wherein said elongate member removably couples to said back panel.

5. The ballistic-resistant garment of claim 4, wherein said elongate member adjustably couples to said back panel for adjustment along a back panel length.

6. The ballistic-resistant garment of claim 2, wherein each of said front panel first and second fasteners comprises a protrusion.

7. The ballistic-resistant garment of claim 6, wherein each of said protrusions comprises a headed pin.

8. The ballistic-resistant garment of claim 6, wherein each of said front panel first and second fasteners is adjustably coupled to said front panel for adjustment along a front panel width.

9. The ballistic-resistant garment of claim 8, wherein each of said front panel first and second fasteners is fixedly coupled to a connector which adjustably couples to said front panel for adjustment along said front panel width.

10. The ballistic-resistant garment of claim 9, wherein said connector slidably engages with a slit disposed in said front panel.

11. The ballistic-resistant garment of claim 10, further comprising a plurality of said slits disposed in generally horizontal spaced apart relation along said front panel width.

12. The ballistic-resistant garment of claim 1, wherein said front and back panels together form a vest-like ballistic-resistant garment which is sleeveless.

13. A ballistic-resistant garment, comprising:

a front panel having a front panel pocket configured to receive a first ballistic-resistant plate;

a front panel first fastener coupled to said front panel;

a front panel second fastener coupled to said front panel;

a back panel having a back panel pocket configured to receive a second ballistic-resistant plate;

an elongate member coupled to said back panel, said elongate member having an elongate member length disposed between opposing elongate member right and left ends;

a plurality of discrete back panel first aperture elements disposed within said elongate member, said back panel first aperture elements located in generally horizontal spaced apart relation proximate said elongate member right end, each of said back panel first aperture elements configured to matably engage with said front panel first fastener to couple said front and back panels to fasten said ballistic-resistant garment about a torso of a wearer; and a plurality of discrete back panel second aperture elements disposed within said elongate member, said back panel second aperture elements located in generally horizontal spaced apart relation proximate said elongate member left end, each of said back panel second aperture elements configured to matably engage with said front panel second fastener to couple said front and back panels to fasten said ballistic-resistant garment about said torso of said wearer.

* * * * *